US012595522B2

(12) United States Patent
Inada et al.

(10) Patent No.: US 12,595,522 B2
(45) Date of Patent: Apr. 7, 2026

(54) METHOD FOR PRODUCING REDUCED IRON

(71) Applicant: NIPPON STEEL CORPORATION, Tokyo (JP)

(72) Inventors: Takanobu Inada, Tokyo (JP); Moritoshi Mizutani, Tokyo (JP); Yutaka Ujisawa, Tokyo (JP); Naoto Yasuda, Tokyo (JP); Hitoshi Funagane, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 686 days.

(21) Appl. No.: 17/921,745

(22) PCT Filed: May 14, 2021

(86) PCT No.: PCT/JP2021/018391
§ 371 (c)(1),
(2) Date: Oct. 27, 2022

(87) PCT Pub. No.: WO2021/241272
PCT Pub. Date: Dec. 2, 2021

(65) Prior Publication Data

US 2023/0167517 A1 Jun. 1, 2023

(30) Foreign Application Priority Data

May 28, 2020 (JP) ..... 2020-093139

(51) Int. Cl.
*C21B 13/00* (2006.01)
*C21B 13/02* (2006.01)

(52) U.S. Cl.
CPC ..... *C21B 13/0073* (2013.01); *C21B 13/02* (2013.01); *C21B 2100/40* (2017.05); *C21B 2100/64* (2017.05)

(58) Field of Classification Search
CPC . C21B 13/0073; C21B 13/02; C21B 2100/40; C21B 2100/64; C21B 2100/26;
(Continued)

(56) References Cited

U.S. PATENT DOCUMENTS 2,609,288 A 9/1952 Stuart
2,862,808 A * 12/1958 Fredrik ..... C21B 13/0086 266/217
(Continued)

FOREIGN PATENT DOCUMENTS

CN 101935732 A 1/2011
CN 105219907 A 1/2016
(Continued)

OTHER PUBLICATIONS

Wang et al., "Simulation analysis on hydrogen reduction shaft furnace", Journal of Chongqing University, vol. 39, No. 4, pp. 57-66, China Academic Journal Electronic Publishing House, Aug. 2016, with English abstract.
(Continued)

*Primary Examiner* — Danielle M. Carda
(74) *Attorney, Agent, or Firm* — Myers Wolin, LLC

(57) ABSTRACT

A method for producing reduced iron that produces reduced iron by reducing iron oxide charged in a shaft furnace, in which a heated gas mixture which contains a reducing gas and a nitrogen gas, the reducing gas containing 90 volume % or more of a hydrogen gas, is blown into the shaft furnace from a tuyere equipped at a lower portion of a reduction zone of the shaft furnace, at least part of the reducing gas is blown into a cooling zone of the reduced iron provided at a lower portion of the shaft furnace at normal temperature, and the reducing gas that has flowed up in the cooling zone is used for reduction of the iron oxide.

2 Claims, 14 Drawing Sheets

(58) Field of Classification Search
CPC ..... C21B 2100/28; C21B 2100/44; C21B 2100/66; Y02P 10/134; F27B 1/16; F27D 17/00
USPC ..... 75/490
See application file for complete search history.

(56) References Cited

U.S. PATENT DOCUMENTS

| | | | |
|---|---|---|---|
| 4,556,417 | A | 12/1985 | Martinez-Vera et al. |
| 6,027,545 | A | 2/2000 | Villarreal-Trevino |
| 2021/0246521 | A1 | 8/2021 | Boehm et al. |

FOREIGN PATENT DOCUMENTS

| | | | | | |
|---|---|---|---|---|---|
| EP | 0018235 | A1 | | 10/1980 | |
| JP | S49-121708 | A | | 11/1974 | |
| JP | S55-144402 | A | | 11/1980 | |
| JP | 2010-46055 | A | | 3/2010 | |
| JP | 2013216929 | A | * | 10/2013 | ..... C21B 13/00 |
| JP | 2016-529383 | A | | 9/2016 | |
| WO | 2006/135984 | A1 | | 12/2006 | |
| WO | 2011/108570 | A1 | | 9/2011 | |
| WO | 2015/016956 | A1 | | 2/2015 | |
| WO | 2019/238720 | A1 | | 12/2019 | |

OTHER PUBLICATIONS

Knop et al., "Prozeβtechnik und Wirtschaftlichkeit Der Stahlerzeugung Über Direktreduktion Auf Wasserstoffbasis", Stahl und Eisen, Maenken Kommunikation Gmbh, vol. 116, No. 11, Nov. 11, 1996, pp. 55-64, XP000639879, ISSN: 0340-4803 (concise explanation is in EPESR, p. 2, 2nd paragraph of EPO form 1703).

The Extended European Search Report with Supplementary European search report and the European Search Opinion, issued by the European Patent Office for corresponding European Patent Application No. 21814169.5-1103, mailed on Nov. 7, 2023.

Direct From Midrex 3rd Quarter 2017, Midrex Technologies Inc., USA, 2017 (https://www.midrex.com/dfm-newsletter/3q-2017-direct-from-midrex/).

Hosokai et al., "Ironmaking with Ammonia at Low Temperature", Environmental Science & Technology (2011), pp. 821-826, vol. 45, No. 2., American Chemical Society.

Vogl et al., "Assessment of hydrogen direct reduction for fossil-free steelmaking", Journal of Cleaner Production, 2018, vol. 203, pp. 736-745 (https://doi.org/10.1016/j.jclepro.2018.08.279), Elsevier Ltd.

Spreitzer, et al., "Reduction of Iron Oxides with Hydrogen—A Review", Steel Research International, 2019, vol. 90, No. 1900108, (DOI: 10.1002/srin.201900108), Wiley-VCH Veriag GmbH&Co KGaA, Weinheim.

* cited by examiner

METHOD FOR PRODUCING REDUCED IRON

CROSS-REFERENCE TO RELATED APPLICATION

This application is a National Phase under 35 U.S.C. 371 of PCT/JP2021/018391, filed on May 14, 2021, and which designated the U.S., which claims priority to Japanese Patent Application No. 2020-093139, filed on May 28, 2020. The contents of each are wholly incorporated herein by reference.

TECHNICAL FIELD

The present disclosure relates to a method for producing reduced iron.

Priority is claimed on Japanese Patent Application No. 2020-93139, filed May 28, 2020, the content of which is incorporated herein by reference.

BACKGROUND ART

A method for producing reduced iron using a shaft furnace (shaft furnace operation) is a representative of a direct reduction process that produces reduced iron from an iron oxide raw material and is becoming widespread in districts where, mainly, natural gas can be procured at a low cost (oil-producing countries). Here, the concept of a conventional shaft furnace operation will be described based on FIG. 18. In the example of FIG. 18, the upper side of a shaft furnace 100 forms a reduction zone 100*a*, and the lower side forms a cooling zone 100*b*. The reduction zone 100*a* is a zone where iron oxide is reduced to produce reduced iron, and the cooling zone 100*b* is a zone where the produced reduced iron is cooled. At a lower portion of the reduction zone 100*a*, a tuyere 100*c* for blowing a reducing gas into the shaft furnace 100 is equipped.

In shaft furnace operation using such a shaft furnace 100, an iron oxide raw material (for example, iron oxide pellets) 200 is charged from the top of the shaft furnace 100, and a reducing gas 300 is blown into the shaft furnace 100 from the tuyere 100*c* equipped at the lower portion of the reduction zone 100*a*. Here, the reducing gas 300 is heated up to a predetermined temperature (blow temperature, for example, approximately 900° C. to 1000° C.) and then blown into the shaft furnace 100. The iron oxide raw material 200 is reduced in a process of descending in the reduction zone 100*a* by the reducing gas 300 that is flowing up from the tuyere 100*c*, the reduction degree becomes approximately 100% when the iron oxide raw material reaches the tuyere level (the same height as the installation position of the tuyere 100*c*), and the temperature is raised to the level of the blow temperature. Reduced iron 210 is produced by means of such a direct reduction process. The reduced iron 210 is cooled in the cooling zone 100*b* in the lower side of the shaft furnace 100 and then discharged from the bottom of the shaft furnace 100. Non Patent Document 1 discloses a technology in which a hydrocarbon-based gas (for example, natural gas) 500 is blown into the cooling zone 100*b*, thereby carrying out the cooling of the reduced iron 210 and a carburizing treatment together. There are also cases where a hot agglomeration treatment of the reduced iron is carried out depending on the form of a final product. Meanwhile, a furnace top gas 400 containing a hydrogen gas, a CO gas, water vapor and a $CO_2$ gas is exhausted from the furnace top of the shaft furnace 100.

The reducing gas 300 that is used in the shaft furnace 100 is obtained by reforming a raw material gas containing a carbon component (for example, natural gas, coke oven gas or the like) 310 by use of water vapor, oxygen or the like, and main components are hydrogen gas ($H_2$) and CO gas (CO).

CITATION LIST

Patent Document

[Patent Document 1]
Japanese Laid-open Patent Publication No. 2010-046055

Non Patent Document

[Non Patent Document 1]
"DIRECT FROM MIDREX 3RD QUARTER 2017" (https://www.midrex.com/dfm-newsletter/3q-2017-direct-from-midrex/)

[Non Patent Document 2]
S. Hosokai, Y. Kashiwaya, K. Matsui, N. Okinaka & T. Akiyama: Environ. Sci. Technol. (2011), 45, p. 821 to 826

SUMMARY

Problems to be Solved

In the conventional shaft furnace operation, the $H_2$/CO volume ratio of the reducing gas is within a range of approximately 1.5 to 4.0. Therefore, the shaft furnace operation is considered as a superior iron and steel manufacturing process to the blast furnace-converter method from the viewpoint of $CO_2$ emission reduction although the shaft furnace operation is a conventional operation. However, in order to pursue iron and steel manufacturing with $CO_2$ zero emission, which will be forced in the future, an additional increase in the volume proportion of a hydrogen gas in the reducing gas is required.

Thus far, a variety of technologies regarding the shaft furnace operation have been proposed; however, in almost all of the technologies, natural gas, coke oven gas and the like containing a carbon component have been used as a raw material gas that serves as a raw material for reducing gases. However, in recent years, a reduced iron maker proposing a process in which natural gas, which is a main raw material gas of reducing gases, is substituted by a hydrogen gas (that is, an operation in which a reducing gas containing a high concentration, almost 100 volume %, of a hydrogen gas is used) has appeared with emphasis on $CO_2$ zero emission (refer to Non Patent Document 1).

The operation using a reducing gas containing a high concentration of a hydrogen gas is possible in terms of stoichiometric consideration based on heat and mass balance but it cannot be said that this operation does not cause any practical problems. Therefore, the present inventors studied whether or not the operation using a reducing gas containing a hydrogen gas can be achieved with no practical problems as an extension of the conventional shaft furnace operation. As a result, a technical problem to be solved was found. The details will be described below, but it has been clarified that, simply when a reducing gas containing a high concentration of a hydrogen gas is used in the conventional shaft furnace operation, a large amount of the hydrogen gas is exhausted from the furnace top without being used for reduction, which creates a problem of an excessive increase in the reducing gas intensity (the in-furnace blowing amount of a reduction gas, a hydrogen gas in this case, necessary to produce one ton of reduced iron). Such a problem is not taken into any consideration in Non Patent Document 1.

Furthermore, in order to more effectively achieve iron and steel manufacturing with $CO_2$ zero emission, it is necessary not only to increase the volume proportion of the hydrogen gas that is contained in the reducing gas (that is, to progress the decarburization of a reducing agent) but also to improve the thermal efficiency of the process (that is, energy saving).

The present disclosure has been made in consideration of the above-described problems, and an objective of the present disclosure is to provide a new and improved method for producing reduced iron capable of decreasing the reducing gas intensity and improving the thermal efficiency even in the case of using a reducing gas containing a high concentration of a hydrogen gas.

Means for Solving the Problem

The present inventors studied whether or not the operation in which a reducing gas containing a hydrogen gas is used can be achieved with no practical problems as an extension of the conventional shaft furnace operation. As a studying method, simulation in which the mathematical model of a shaft furnace was used was carried out. The model was built based on the chemical engineering methods described in non-patent Document (for example, Hara et al.: Tetsu-to-Hagane, Vol. 62 (1976), Issue 3, p. 315 and Yamaoka et al., Tetsu-to-Hagane, Vol. 74 (1988), Issue 12, p. 2254) and enables the theoretical analysis and estimation of heat and mass transfer in shaft furnaces such as a chemical reaction, including a reduction reaction of iron oxide by a reducing gas, and a heat transfer phenomenon. A shaft furnace operation in which a reducing gas containing a high concentration of a hydrogen gas was used was simulated using the present mathematical model, and macroscopic heat and mass transfer was evaluated.

Table 1 shows prerequisites (calculation conditions) provided for case studies. The present calculation conditions were set based on typical operation conditions so that the generality of results was not impaired in view of the purpose of evaluating the macroscopic heat and mass transfer.

TABLE 1

| | | | |
|---|---|---|---|
| Reduction zone height | 5 m | Iron oxide pellets TFe | 66 wt % |
| Cooling zone height | 2 m | Iron oxide pellets particle diameter | 10.5 mm |
| Furnace inner diameter | 6 m | Furnace wall heat dissipation | None |

FIG. 14 is a graph showing the minimum amount of heat necessary to produce one ton of reduced iron (reduction degree: 100%) using a reducing gas (900° C.) (hereinafter, also referred to as "heat amount intensity") (MJ/t-Fe) for each $H_2$/CO volume ratio of the reducing gas. In the present specification, "/t-Fe" indicates "value per ton of reduced iron". The reduction degree of reduced iron is defined by the following equation.

(Reduction degree)=(1−(amount of unreduced oxygen in reduced iron)/(amount of reducible oxygen in reduced iron raw material))×100(%)

In FIG. 14, "Sensible heat taken out by finished product DRI" is sensible heat that is taken out by reduced iron, which is a finished product, to the outside of the furnace, "sensible heat taken out by furnace top gas" is sensible heat that is taken out by the furnace top gas to the outside of the furnace and "reduction reaction heat" is heat necessary for the reduction reaction of the iron oxide. As is clear from FIG. 14, the heat amount intensity increases as the $H_2$/CO volume ratio of the reducing gas increases. The $H_2$/CO volume ratios 80/20 to 66/33 correspond to the compositions of representative reducing gases for the conventional shaft furnace operation. In addition, FIG. 15 is a graph showing the minimum amount of the reducing gas necessary to produce one ton of reduced iron (reduction degree: 100%) using a reducing gas (900° C.) (that is, the reducing gas intensity) ($Nm^3$/t-Fe) for each $H_2$/CO volume ratio of the reducing gas. As is clear from FIG. 15, the reducing gas intensity increases as the $H_2$/CO volume ratio of the reducing gas increases.

The reason for obtaining the results as in FIG. 14 and FIG. 15 is that, as shown by the following formula (1) and formula (2), the reduction reaction by a hydrogen gas becomes an endothermic reaction as opposed to the reduction reaction by a CO gas being an exothermic reaction.

$$Fe_2O_3+3H_2 \rightarrow 2Fe+3H_2O-854\ MJ/t\text{-}Fe \quad (1)$$

$$Fe_2O_3+3CO \rightarrow 2Fe+3CO_2+246\ MJ/t\text{-}Fe \quad (2)$$

That is, as the volume proportion of the hydrogen gas in the reducing gas increases, the amount of heat input to cover the reduction reaction heat by the hydrogen gas (reduction reaction heat) increases. In addition, in a case where the blow temperature of the reducing gas is not changed, as shown in FIG. 15, the reducing gas intensity needs to increase.

Attention should be paid to the deterioration of the utilization ratio of the reducing gas attributed to the increase in the reducing gas intensity. The utilization ratios of the reducing gas, which are calculate from the composition of the furnace top gas, are shown in FIG. 16. FIG. 16 is a graph showing the utilization ratio (%) of the reducing gas for each $H_2$/CO volume ratio of the reducing gas. The utilization ratio of the reducing gas can be obtained by dividing the total volume of water vapor and the $CO_2$ gas that are contained in the furnace top gas by the total volume of the hydrogen gas, water vapor, the CO gas and the $CO_2$ gas that are contained in the furnace top gas. Since the amount of the reduction reaction necessary to produce one ton of reduced iron (reduction degree: 100%) (in other words, the deoxidation amount) is the same, an increase in the reducing gas intensity increases the reducing gas that is not involved in the reduction reaction, and the reducing gas, that is, the hydrogen gas is wasted for heat supply. That is, as the volume proportion of the hydrogen gas in the reducing gas increases, it is necessary to supply a larger amount of the hydrogen gas into the shaft furnace as a heat supply source in order to cover the reduction reaction heat by the hydrogen gas. Furthermore, as a result of a large amount of the hydrogen gas being blown into the shaft furnace, a majority of the hydrogen gas does not react in the shaft furnace and is exhausted as the furnace top gas. Therefore, the utilization ratio of the reducing gas decreases. As described above, simply when a reducing gas containing a high concentration of a hydrogen gas is used in the conventional shaft furnace operation, a large amount of the hydrogen gas is wasted without being used for reduction, which creates a technical problem of an excessive increase in the hydrogen gas intensity.

Theoretically, it is also possible to cover the reduction reaction heat by the hydrogen gas by raising the blow temperature of the reducing gas. FIG. 17 is a graph showing the relationship between the reducing gas intensity ($Nm^3$/t-

Fe) and the blow temperature (° C.) of the reducing gas for each $H_2$/CO volume ratio of the reducing gas. As shown in FIG. 17, in the case of using a reducing gas containing a high concentration, 90 volume % or more, of a hydrogen gas, in order to carry out operation with approximately the same reducing gas intensity as that for the conventional shaft furnace operation, it is necessary to significantly raise the blow temperature relative to that for the conventional shaft furnace operation by at least 100° C. or more (200° C. or more when the $H_2$/CO volume ratio is 100/0), which is roughly estimated. However, in a case where the blow temperature of a reducing gas containing a high concentration of a hydrogen gas is significantly raised, there is a concern of the occurrence of a so-called sticking phenomenon in which reduced iron particles in the furnace adhere to each other. Furthermore, as the high-temperature hydrogen gas is handled, facility cost will increase in order to secure the safety operation and to cope with hydrogen embrittlement.

In summary, in the case of carrying out shaft furnace operation using a reducing gas containing a high concentration of a hydrogen gas, a fundamental problem is how to cover the reduction reaction heat by the hydrogen gas. As a method for solving such a fundamental problem, the present inventors considered the blowing of a nitrogen gas, which does not affect the reduction reaction in the shaft furnace, into the shaft furnace together with the reducing gas. In addition, the present inventors caused the nitrogen gas to cover at least part of heat necessary for the reduction reaction by the hydrogen gas. As a result, it was possible to reduce the reducing gas intensity and also to drop the blow temperature of the reducing gas.

Furthermore, the present inventors paid attention to the sensible heat of reduced iron from the viewpoint of improving the thermal efficiency. That is, almost 100% of the iron oxide raw material that has reached the tuyere level is reduced and turned into reduced iron. The temperature of this reduced iron becomes an extremely high temperature that is, roughly, substantially the same as the blow temperature. The present inventors considered that, if such sensible heat of reduced iron can be used for the heating of the reducing gas, it is possible to further improve the thermal efficiency. Therefore, the present inventors blew at least part of the reducing gas that was supplied from the outside into the cooling zone and cooled the reduced iron with this reducing gas. The reducing gas blown into the cooling zone cools the reduced iron while flowing up in the cooling zone. Accordingly, the reducing gas is heated by the sensible heat of the reduced iron. The reducing gas can be heated up to, approximately, the blow temperature level when reaching the tuyere level by appropriately adjusting the amount of the reducing gas that is blown into the cooling zone (the adjustment method will be described below). In addition, the reducing gas heated by the sensible heat of the reduced iron is used for the reduction of the iron oxide. This makes it possible to heat at least part of the reducing gas that is used for the reduction of the iron oxide by the sensible heat of the reduced iron, and thus the heating load of the reducing gas is reduced, and the thermal efficiency improves.

Although the social demand of the hydrogen gas is expected to explosively expand, it is not clear whether or not a hydrogen gas that covers the social demand (in terms of not only the amount but also the price) can be stably procured. Furthermore, the hydrogen gas is extremely explosive and thus needs to be extremely carefully transported. Therefore, in order to commercialize the hydrogen reduction process, it is necessary to diversify the hydrogen gas supply source and, preferably, to secure a highly portable hydrogen gas supply source. Therefore, the present inventors paid attention to an ammonia gas as the hydrogen gas supply source and studied the blowing of the ammonia gas into the cooling zone. Ammonia is industrially produced in large quantities as a chemical fertilizer and also can be easily liquefied and thus can be said as a hydrogen carrier having excellent portability.

Furthermore, the ammonia gas blown into the cooling zone cools the reduced iron while flowing up in the cooling zone. Accordingly, the ammonia gas is heated by the sensible heat of the reduced iron. After that, the ammonia gas decomposes into a nitrogen gas and a hydrogen gas with the reduced iron serving as a catalyst. That is, the decomposition reaction of the ammonia gas is an endothermic reaction but heat necessary for the decomposition reaction is supplied from the reduced iron. In addition, the reduced iron itself serves as a catalyst to accelerate the decomposition of the ammonia gas. The nitrogen gas and the hydrogen gas generated by the decomposition of the ammonia gas flow up while being further heated by the sensible heat of the reduced iron and reach the tuyere. The nitrogen gas and the hydrogen gas can be heated up to, approximately, the blow temperature level when reaching the tuyere level by appropriately adjusting the amount of the ammonia gas that is blown into the cooling zone (the adjustment method will be described below). In addition, the hydrogen gas and the nitrogen gas generated by the decomposition of the ammonia gas are used as part of a gas mixture to be described below. Therefore, the blowing of the ammonia gas into the cooling zone makes it possible to use the ammonia gas as a hydrogen gas supply source and also makes it possible to improve the thermal efficiency. The present disclosure has been made based on these findings.

That is, according to a certain viewpoint of the present disclosure, provided is a method for producing reduced iron that produces reduced iron by reducing iron oxide charged in a shaft furnace, in which a heated gas mixture which contains a reducing gas and a nitrogen gas, the reducing gas containing 90 volume % or more of a hydrogen gas, is blown into the shaft furnace from a tuyere equipped at a lower portion of a reduction zone of the shaft furnace, at least part of the reducing gas is blown into a cooling zone of the reduced iron provided at a lower portion of the shaft furnace at normal temperature, and the reducing gas that has flowed up in the cooling zone is used for reduction of the iron oxide.

Here, the method may include separating and collecting at least unreacted hydrogen gas and nitrogen gas from a furnace top gas of the shaft furnace and reusing the separated and collected hydrogen gas and nitrogen gas as part of the gas mixture.

According to another viewpoint of the present disclosure, provided is a method for producing reduced iron that produces reduced iron by reducing iron oxide charged in a shaft furnace, in which a heated gas mixture which contains a reducing gas and a nitrogen gas, the reducing gas containing 90 volume % or more of a hydrogen gas, is blown into the shaft furnace, an ammonia gas is blown into a cooling zone of the reduced iron provided at a lower portion of the shaft furnace at normal temperature, and a hydrogen gas and a nitrogen gas generated by decomposition of the ammonia gas that flows up in the cooling zone are used as part of the gas mixture.

The method may include separating and collecting at least unreacted hydrogen gas and nitrogen gas from a furnace top gas of the shaft furnace and reusing part of the separated and collected hydrogen gas and nitrogen gas as part of the gas mixture and using a remainder as a fuel gas at the time of heating the gas mixture.

Effects

According to the above-described viewpoints of the present disclosure, it is possible to reduce the reducing gas intensity even in the case of using a reducing gas containing a high concentration of a hydrogen gas. Furthermore, it is possible to improve the thermal efficiency.

DETAILED DESCRIPTION

Hereinafter, preferable embodiments of the present disclosure will be described in detail with reference to the accompanying drawings. Numerical limiting ranges expressed using "to" include numerical values before and after "to" as the lower limit value and the upper limit value. Numerical values expressed with "more than" or "less than" are not included in the numerical ranges.

1. First Embodiment

Figure 1:
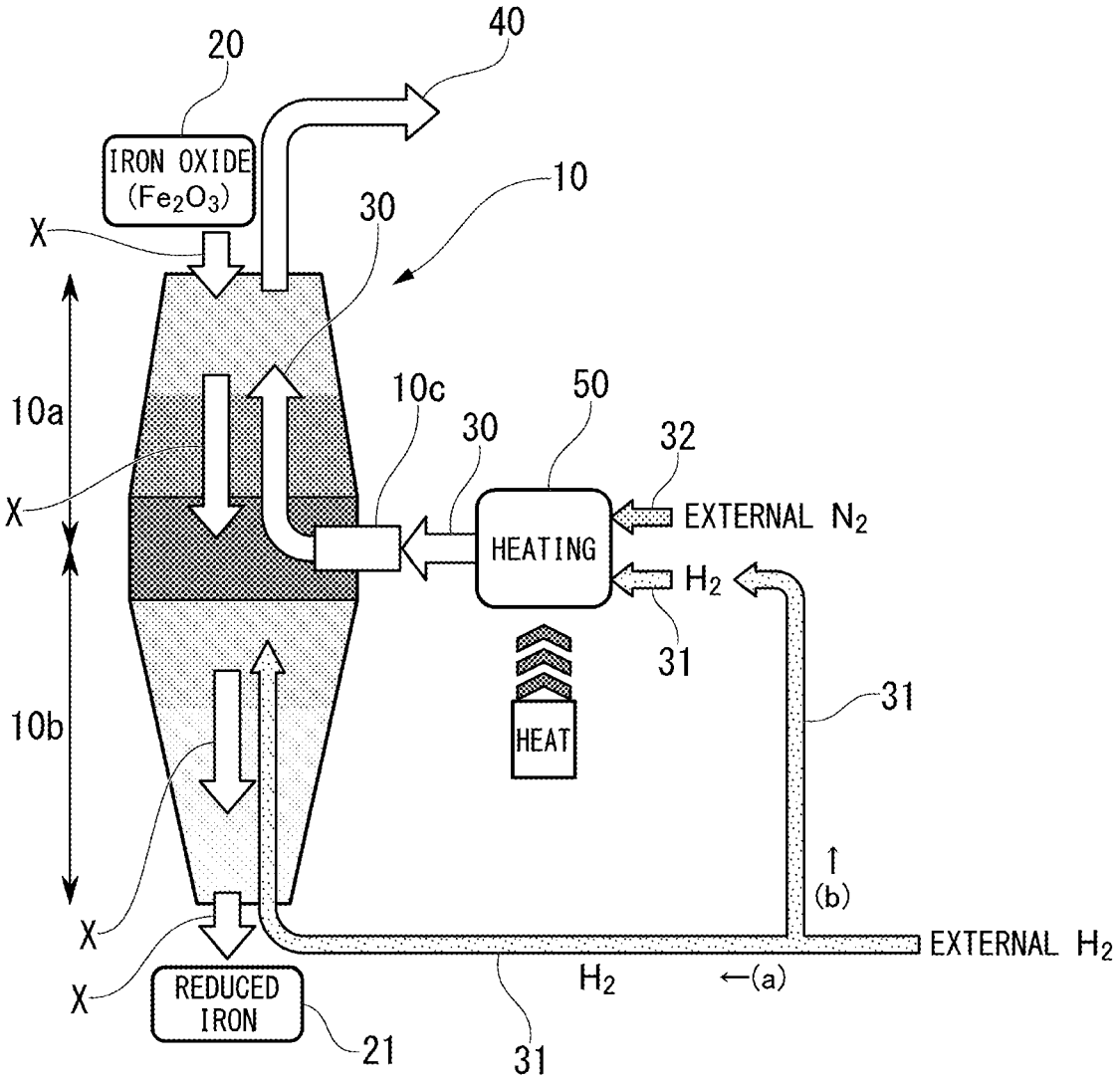
FIG. 1 is an explanatory view showing the process flow of a method for producing reduced iron according to a first embodiment.

First, the process flow of a method for producing reduced iron (shaft furnace operation) according to a first embodiment will be described based on FIG. 1. In the first embodiment, schematically, a heated gas mixture 30 which contains a reducing gas 31 containing 90 volume % or more of a hydrogen gas and a nitrogen gas 32 is blown into a shaft furnace 10. Furthermore, in the first embodiment, at least part of the reducing gas 31 is blown into a cooling zone of the reduced iron provided at a lower portion of the shaft furnace 10 at normal temperature.

In more detail, the upper side (approximately the upper half) of the shaft furnace 10 forms a reduction zone 10*a*, and the lower side (approximately the lower half) forms a cooling zone 10*b*. The reduction zone 10*a* and the cooling zone 10*b* may not be divided as in this example, and, for example, the reduction zone 10*a* may be set to be longer. At a lower portion (the boundary between the reduction zone 10*a* and the cooling zone 10*b*) of the reduction zone 10*a*, a tuyere 10*c* for blowing the gas mixture 30 into the shaft furnace 10 is equipped. In addition, while not shown, not only a discharge gate of reduced iron but also a tuyere for blowing the reducing gas into the cooling zone are equipped at the lower end of the shaft furnace 10.

The method for producing reduced iron according to the first embodiment includes a step of heating the gas mixture 30 containing the reducing gas 31 and the nitrogen gas 32, a step of blowing the heated gas mixture 30 into the shaft furnace 10 and a step of blowing into at least part of the reducing gas 31 into the cooling zone 10*b* of reduced iron provided at the lower portion of the shaft furnace 10. Steps other than these may be the same as those of the conventional shaft furnace operation.

For example, the reducing gas 31 and the nitrogen gas 32, which are supplied from the outside, are introduced into a heating furnace 50, and the reducing gas 31 and the nitrogen gas 32 are heated together in the heating furnace 50. This makes the reducing gas 31 and the nitrogen gas 32 mixed in the heating furnace 50 to become the gas mixture 30, and the gas mixture 30 is heated up to a predetermined temperature.

As described above, the reducing gas 31 contains 90 volume % or more (volume % with respect to the total volume of the reducing gas 31) of a hydrogen gas. That is, the hydrogen gas concentration of the reducing gas 31 becomes 90 volume % or more. From the viewpoint of iron and steel manufacturing with $CO_2$ zero emission, the hydrogen gas concentration of the reducing gas 31 is preferably as high as possible in a range of 90 volume % or more and preferably 100 volume % (that is, the reducing gas 31 is only composed of a hydrogen gas). Additionally, as a method for heating the gas mixture 30, an electric heater is preferably used, and, in a case where the gas mixture is heated by combustion heating, a combustion gas mainly containing hydrogen is preferable.

In a case where the hydrogen gas concentration of the reducing gas 31 becomes 90 volume % or more and less than 100 volume %, the reducing gas 31 may contain a reducing gas other than a hydrogen gas. As such a reducing gas, for example, not only a CO gas but also a hydrocarbon gas and the like are included. The hydrocarbon gas generates a CO gas in the shaft furnace. In the following description, unless particularly otherwise described, description will be made on the assumption that the hydrogen gas concentration of the reducing gas 31 is 100 volume %, that is, the reducing gas 31 is only composed of a hydrogen gas.

The nitrogen gas 32 is an inert gas that is not directly involved in any reduction reactions in the shaft furnace and simply functions as a carrier that carries sensible heat into the shaft furnace 10. Therefore, according to the first embodiment, there is no need to apply a heating load only to the hydrogen gas, which makes it possible to carry out shaft furnace operation at an appropriate blow temperature (predetermined temperature).

The amount of the nitrogen gas 32 added to the reducing gas 31 will be described below in detail, but the effects of the present embodiment (the reduction of the hydrogen gas intensity and the dropping of the blow temperature of the hydrogen gas) can be obtained only by slightly adding the nitrogen gas 32 to the reducing gas 31. On the other hand, when the nitrogen gas 32 is excessively added, the deceleration of the reduction reaction rate of iron oxide due to a decrease in the hydrogen concentration in the gas mixture 30 surpasses the effect of compensating the reduction reaction heat by heat supply from the nitrogen gas 32. In this case, the effects of the present embodiment are saturated. From such a viewpoint, the amount of the nitrogen gas 32 added is preferably 90 volume % or less of the reducing gas 31.

The gas mixture 30 is preferably composed only of the above-described reducing gas 31 and nitrogen gas 32 but may contain a gas other than the reducing gas 31 and the nitrogen gas 32 to an extent that the effects of the present embodiment are not affected.

In the heating furnace 50, the gas mixture 30 is heated up to a predetermined temperature (the temperature of the gas mixture 30 at the time of being blown into the shaft furnace, that is, the blow temperature). The predetermined temperature may be adjusted as appropriate depending on the status or the like of shaft furnace operation, and, as described below, the predetermined temperature can be dropped to be lower than that in a case where the nitrogen gas 32 is not added. This is because the nitrogen gas 32 functions as a carrier of sensible heat. The predetermined temperature is preferably 900° C. or lower. The lower limit value of the predetermined temperature is not particularly limited as long as shaft furnace operation by the first embodiment is possible and may be, for example, approximately 750° C.

The gas mixture 30 is heated up to the predetermined temperature and then blown into the shaft furnace 10. An iron oxide raw material 20 is charged from the top of the shaft furnace 10. The kind of the iron oxide raw material 20 does not particularly matter and may be the same as in the conventional shaft furnace operation. An example of the iron oxide raw material 20 is iron oxide pellets. The iron oxide raw material 20 charged in the shaft furnace 10 descends in the reduction zone 10*a*. The arrow X in the drawing indicates the moving direction of the iron oxide raw material 20 or reduced iron 21 in the shaft furnace 10.

The gas mixture 30 blown into the shaft furnace 10 flows up in the reduction zone 10*a* of the shaft furnace 10. The reducing gas 31 in the gas mixture 30 reduces the iron oxide raw material 20 that is descending in the reduction zone 10*a*, whereby the reduced iron 21 is produced. A reduction reaction by the hydrogen gas is an endothermic reaction, but the reduction reaction heat is covered not only by sensible heat from the reducing gas 31 but also by sensible heat from the nitrogen gas 32. The reduction degree of the reduced iron 21 becomes approximately 100% when the reduced iron 21 reaches the tuyere level (the same height as the tuyere 10*c*), and the temperature of the reduced iron 21 is raised to the level of the blow temperature. A furnace top gas 40 is exhausted from the furnace top of the shaft furnace 10. The furnace top gas 40 contains not only an unreacted hydrogen gas but also water vapor and the nitrogen gas 32.

After that, the reduced iron 21 moves into the cooling zone 10*b*. At least part of the reducing gas 31 that is supplied from the outside is blown into (the lower portion of) the cooling zone 10*b* at normal temperature. That is, in the first embodiment, part of the reducing gas 31 that is supplied from the outside (the reducing gas 31 that is supplied along a supply line (a) in FIG. 1) is blown into the cooling zone 10*b* at normal temperature, and the rest (the reducing gas 31 that is supplied along a supply line (b) in FIG. 1) is heated together with the nitrogen gas 32 and blown into the reduction zone 10*a* of the shaft furnace 10 from the tuyere 10*c*. The reducing gas 31 blown into the cooling zone 10*b* cools the reduced iron 21 while flowing up in the cooling zone 10*b*. Accordingly, the reducing gas 31 is heated by the sensible heat of the reduced iron 21. In addition, the reducing gas 31 that has flowed up and has been heated in the cooling zone is used for the reduction of the iron oxide raw material 20. The sensible heat of the reduced iron 21 is also sensible heat supplied to the gas mixture 30 by the heating furnace 50, and thus the reducing gas 31 blown into the cooling zone 10*b* collects part of sensible heat supplied to the gas mixture 30 by the heating furnace 50. Therefore, the heating load of the reducing gas is reduced, and the thermal efficiency improves.

Here, "normal temperature" is not particularly limited as long as normal temperature is within a temperature range that is recognized as normal temperature in a technical field to which the present disclosure belongs and may be in a range of, for example, approximately 25±10° C. Furthermore, the intensity (blowing amount) ($Nm^3$/t-Fe) of the reducing gas 31 that is blown into the cooling zone 10*b* is preferably set such that, for example, the reduction degree of the reduced iron 21 that is exhausted from the shaft furnace 10 becomes 100% (or a value close to 100%, for example, 95%) and the temperature of the reduced iron 21 is cooled to approximately normal temperature (for example, normal temperature to approximately normal temperature+30° C.). For example, in a case where the blow temperature becomes 900° C. and the amount of the nitrogen gas 32 added becomes 330 $Nm^3$/t-Fe, a specific range of the blowing amount becomes approximately 450 to 550 $Nm^3$/t-Fe (refer to FIG. 4 and FIG. 5).

Figure 2:
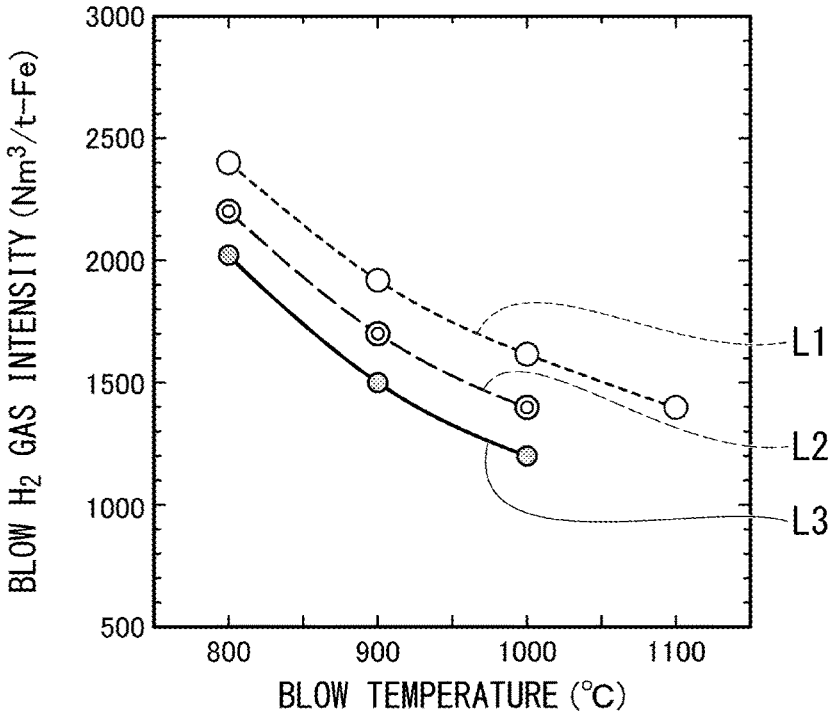
FIG. 2 is a graph showing a relationship between the blow temperature of a gas mixture and a hydrogen gas intensity for each amount of a nitrogen gas added.
Figure 3:
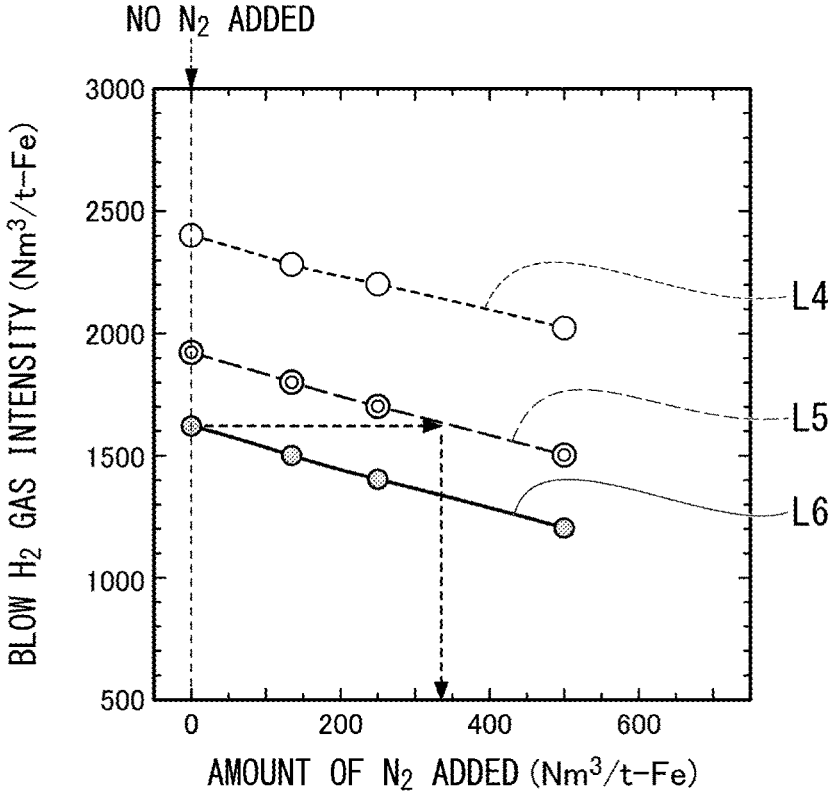
FIG. 3 is a graph showing a relationship between the amount of the nitrogen gas added and the hydrogen gas intensity for each blow temperature of the gas mixture.

Next, among the effects of the first embodiment, an effect of the gas mixture 30 will be described. The present inventors simulated the shaft furnace operation according to the first embodiment using the above-described mathematical model. In addition, shaft furnace operation in which the nitrogen gas 32 was not added was also simulated in order for comparison. The results are shown in FIG. 2 and FIG. 3. The calculation conditions are the same as those in Table 1. In addition, the hydrogen gas concentration of the reducing gas 31 was set to 100 volume %. In addition, the reduction degree of the reduced iron 21 was made to become 100% at the tuyere level. In addition, in the present simulation, the reducing gas 31 was fully injected into the heating furnace 50.

Figure 15:
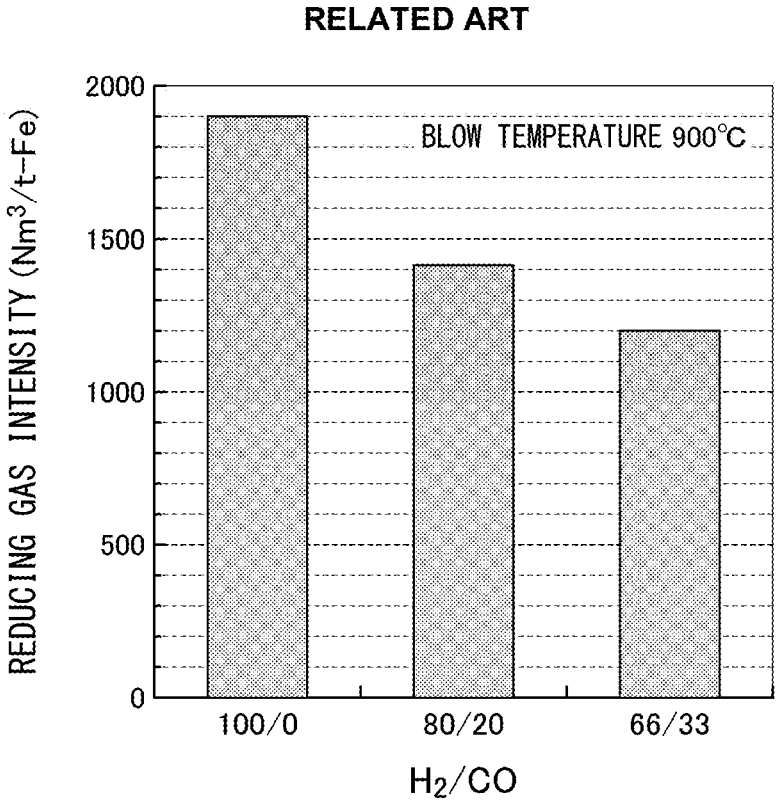
FIG. 15 is a graph showing the trial calculation result of the reducing gas intensity ($Nm^3$/t-Fe) at the time of producing one ton of reduced iron using a reducing gas (900° C.) for each $H_2$/CO volume ratio of the reducing gas.
Figure 16:
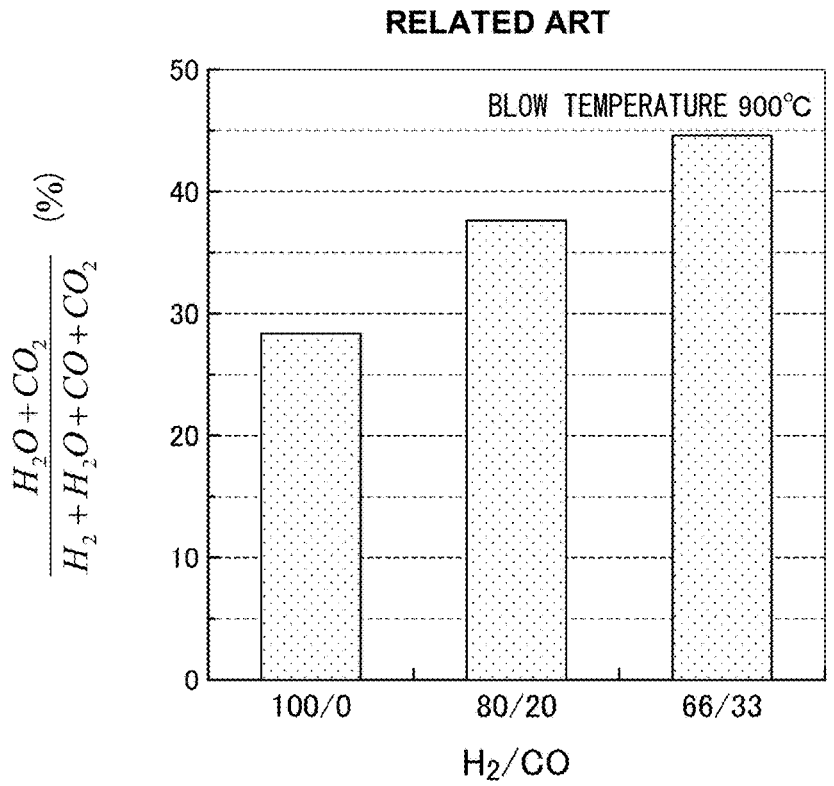
FIG. 16 is a graph showing the utilization ratio (%) of the reducing gas for each $H_2$/CO volume ratio of the reducing gas.
Figure 17:
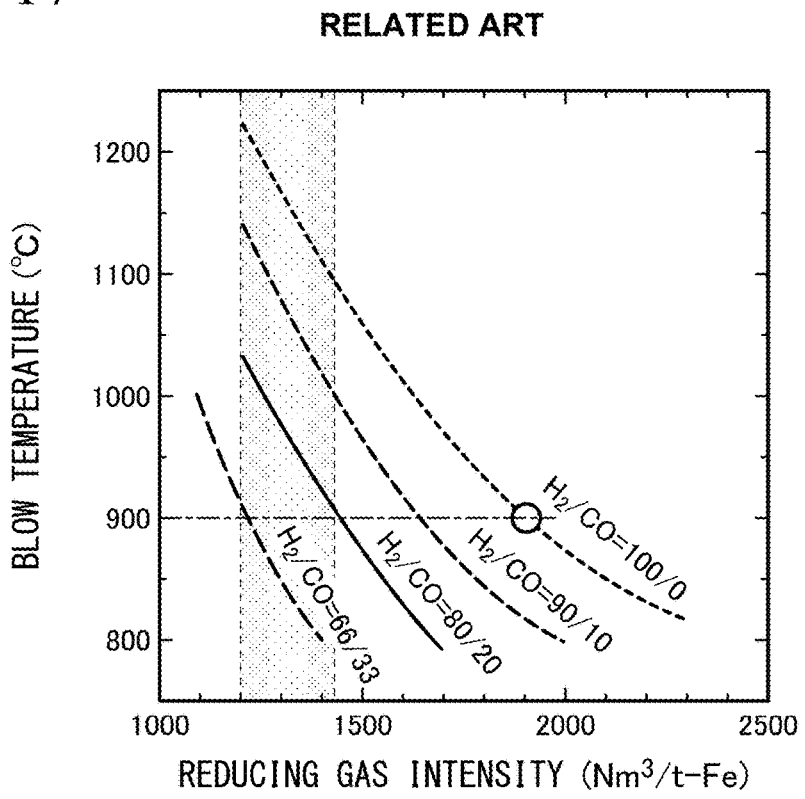
FIG. 17 is a graph showing a relationship between the reducing gas intensity ($Nm^3$/t-Fe) and the blow temperature (° C.) of the reducing gas for each $H_2$/Co volume ratio of the reducing gas.
Figure 18:
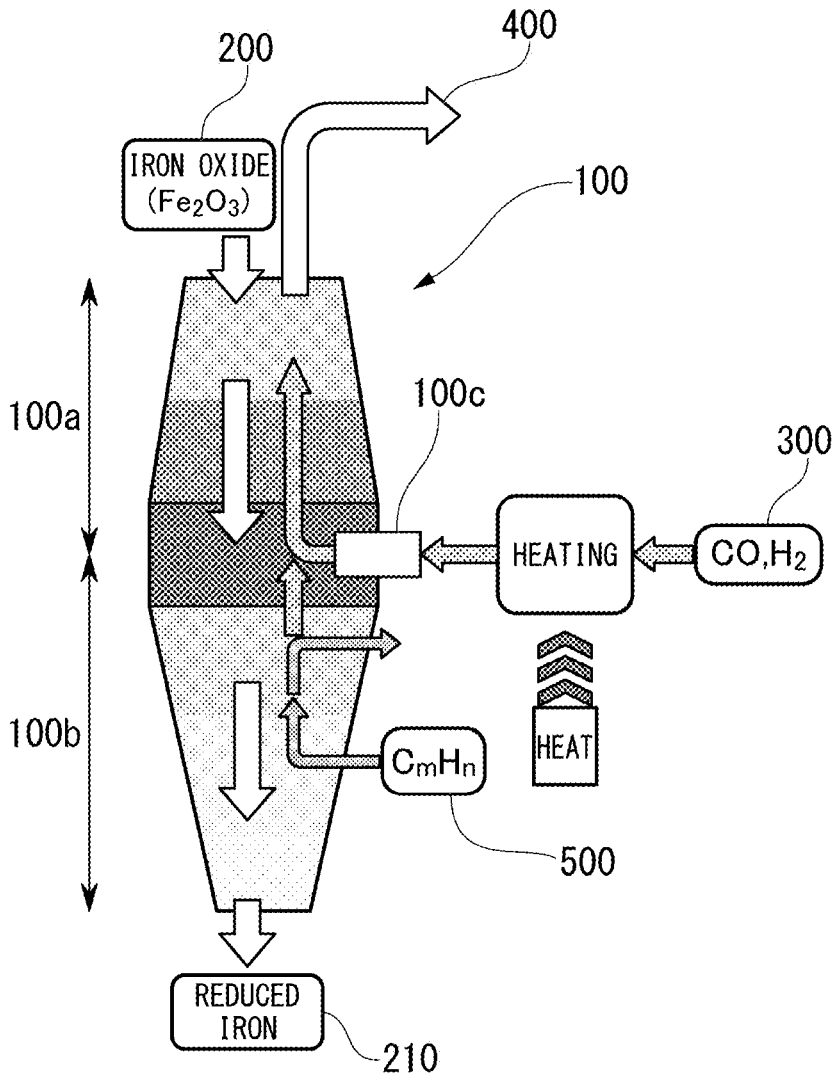
FIG. 18 RELATED ART
FIG. 18 is an explanatory view showing the process flow of a conventional shaft furnace operation.

FIG. 2 shows the relationship between the blow temperature (° C.) of the gas mixture 30 and the hydrogen gas intensity ($Nm^3$/t-Fe) for each amount of the nitrogen gas 32 added. The graph L1 indicates the above-described relationship when the nitrogen gas is not added, the graph L2 indicates the above-described relationship when 250 $Nm^3$/t-Fe of the nitrogen gas is added to the reducing gas 31 and the graph L3 indicates the above-described relationship when 500 $Nm^3$/t-Fe of the nitrogen gas is added to the reducing gas 31. Therefore, the graphs L2 and L3 correspond to the shaft furnace operation according to the first embodiment. Since the hydrogen gas concentration of the reducing gas 31 is 100 volume %, the hydrogen gas intensity can be read as the reducing gas intensity. According to the graphs L2 and L3 in FIG. 2, when the blow temperature becomes 900° C., the reducing gas intensity becomes approximately 1500 to 1700 $Nm^3$/t-Fe. FIG. 15 shows that, in the conventional shaft furnace operation (the $H_2$/CO volume ratio of the reducing gas is 80/20 to 66/33), when the blow temperature becomes 900° C., the reducing gas intensity becomes approximately 1200 to 1400 $Nm^3$/t-Fe. Therefore, the addition of the nitrogen gas 32 to the reducing gas 31 makes it possible to produce reduced iron on substantially the same blow temperature level (for example, 900° C.) and the same reducing gas intensity level (for example, approximately 1500 to 1700 $Nm^3$/t-Fe) as those in the conventional shaft furnace operation even when the hydrogen gas concentration of the reducing gas 31 is a high concentration (here, 100 volume %).

Therefore, even in a case where a reducing gas containing a high concentration of a hydrogen gas is used, it is possible to reduce the reducing gas intensity and to drop the blow temperature of the gas mixture 30 (that is, the blow temperature of the reducing gas 31). Furthermore, it is also found that, as the amount of the nitrogen gas 32 added increases, the reducing gas intensity decreases, and the blow temperature of the reducing gas 31 also drops. When the blow temperature of the reducing gas 31 drops, for example, sticking or the like is suppressed.

FIG. 3 is a view showing the relationship of FIG. 2 arranged to the relationship between the amount of the nitrogen gas 32 added ($Nm^3$/t-Fe) and the hydrogen gas intensity ($Nm^3$/t-Fe). That is, FIG. 3 shows the relationship between the amount of the nitrogen gas 32 added ($Nm^3$/t-Fe) and the hydrogen gas intensity ($Nm^3$/t-Fe) for each blow temperature (° C.) of the gas mixture 30. The graph L4 indicates the blow temperature becomes 800° C., the graph L5 indicates the above-described relationship when the blow temperature becomes 900° C. and the graph L6 indicates the above-described relationship when the blow temperature becomes 1000° C. According to the graphs L4 to L6, it is found that, in all of the blow temperatures, the hydrogen gas intensity decreases simply by adding a small amount of the nitrogen gas 32.

Furthermore, when attention is paid to the graphs L5 and L6, addition of 330 $Nm^3$/t of the nitrogen gas to the reducing gas 31 makes it possible to drop the blow temperature of the gas mixture 30 from 1000° C. to 900° C. while maintaining the hydrogen gas intensity. Therefore, addition of the nitrogen gas 32 to the reducing gas 31 makes it possible to drop the blow temperature and, furthermore, to suppress sticking.

Furthermore, when attention is paid to the graph L5 (the blow temperature of 900° C.), addition of 330 $Nm^3$/t-Fe of the nitrogen gas 32 to the reducing gas 31 makes it possible to reduce the hydrogen gas intensity by approximately 300 $Nm^3$/t-Fe. This means that 330 $Nm^3$/t of the nitrogen gas 32 and 300 $Nm^3$/t-Fe of the hydrogen gas are approximately equivalent to each other from the viewpoint of heat and reaction manipulation. Furthermore, from another angle, the amount of the reduced iron 21 produced can also be controlled by adjusting the amount of the nitrogen gas 32 added under a condition where the blow temperature is constant. For example, when the amount ($Nm^3$/t-Fe) of the nitrogen gas 32 added is increased without changing the blow temperature and the blowing amount of the hydrogen gas per unit time, the amount of the reduced iron 21 produced per unit time increases.

The reason for the fact that the seemingly incomprehensible equivalence relationship is established or the seemingly mysterious operation manipulation is possible is that, in a case where shaft furnace operation is carried out using a reducing gas containing a high concentration of a hydrogen gas, a reduction reaction, the rate of which is controlled by heat supply, occurs (that is, the temperature level in the furnace is appropriately held by the amount of heat that is taken into the shaft furnace 10, so that a reduction reaction smoothly proceeds) in the shaft furnace 10.

As described above, according to the first embodiment, since the gas mixture 30 of the reducing gas 31 and the nitrogen gas 32 is blown into the shaft furnace 10, the nitrogen gas 32 can be used as a carrier of sensible heat. This makes it possible to decrease the reducing gas intensity and makes it possible to drop the blow temperature of the gas mixture 30 even in a case where shaft furnace operation is carried out using the reducing gas 31 containing a high concentration of a hydrogen gas as shown in, for example, FIG. 2 and FIG. 3.

Figure 19:
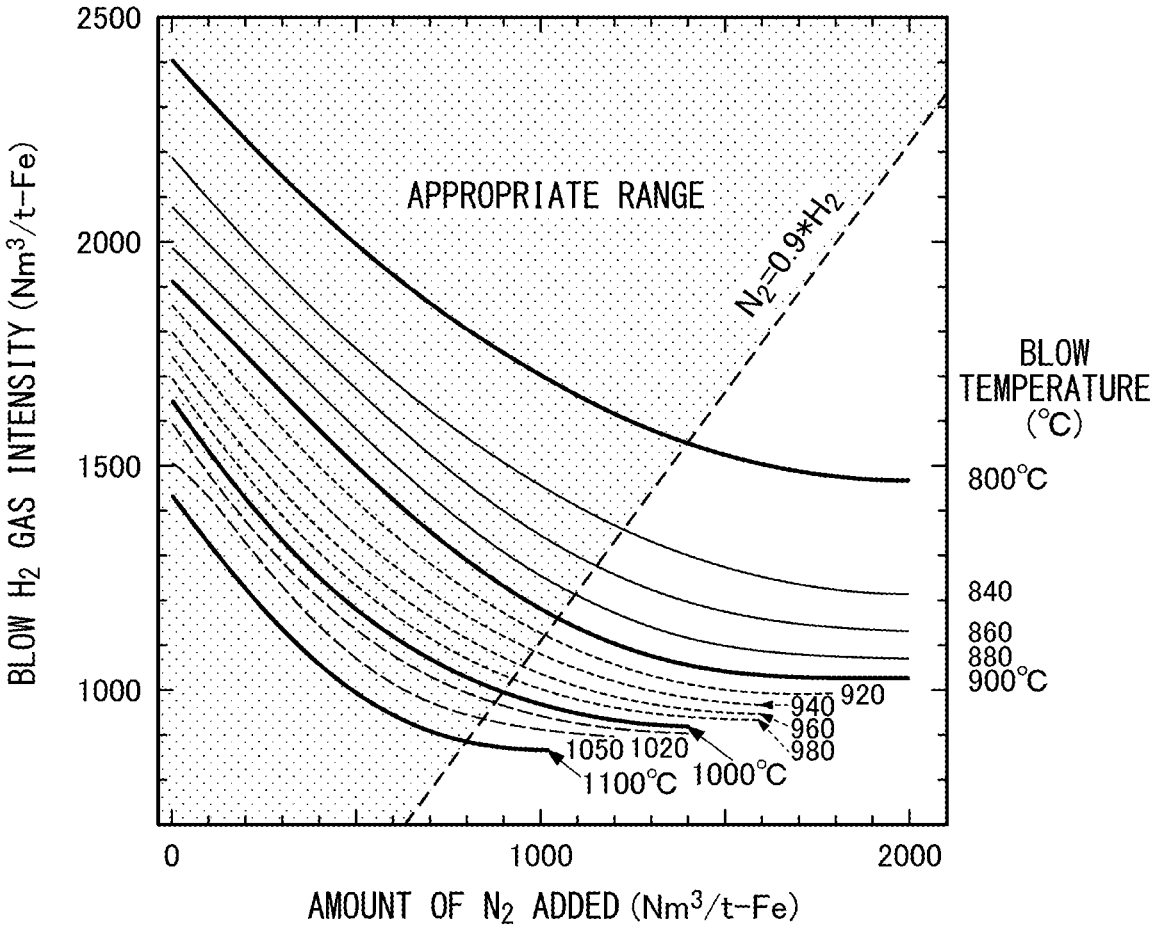
FIG. 19 is a graph showing a relationship between the amount of a nitrogen gas added and the hydrogen gas intensity for each blow temperature of a gas mixture.

The saturation of the effects by the excessive injection of the nitrogen gas 32 will be described based on FIG. 19. The definitions of the vertical axis and horizontal axis of FIG. 19 are the same as those of FIG. 3. However, the horizontal axis of FIG. 19 shows a larger range of the amount of the nitrogen gas added than in FIG. 3. That is, the horizontal axis of FIG. 19 is an extended version of the horizontal axis of FIG. 3. The graphs drawn in FIG. 19 are the same as the graphs L4 to L6 in FIG. 3. The blow temperatures of these graphs are 800° C., 840° C., 860° C., 880° C., 900° C., 920° C., 940° C., 960° C., 980° C., 1000° C., 1020° C., 1050° C. and 1100° C. from above.

As shown in FIG. 19 and described in the above paragraph, when the nitrogen gas 32 is excessively added to the reducing gas 31, the effects of the present embodiment are saturated. Conditions under which the effects are saturated vary with the condition of the blow temperature, but it can be said that the effects of the present embodiment can be taken advantage of when a condition under which the volume flow rate (amount added) of the nitrogen gas 32 is set to approximately 90 volume % or less of the volume flow rate of the reducing gas 31 (that is, a condition under which the gas mixture 30 contains the nitrogen gas 32 at a proportion of 90 volume % or less of the reducing gas 31) is satisfied.

Figure 4:
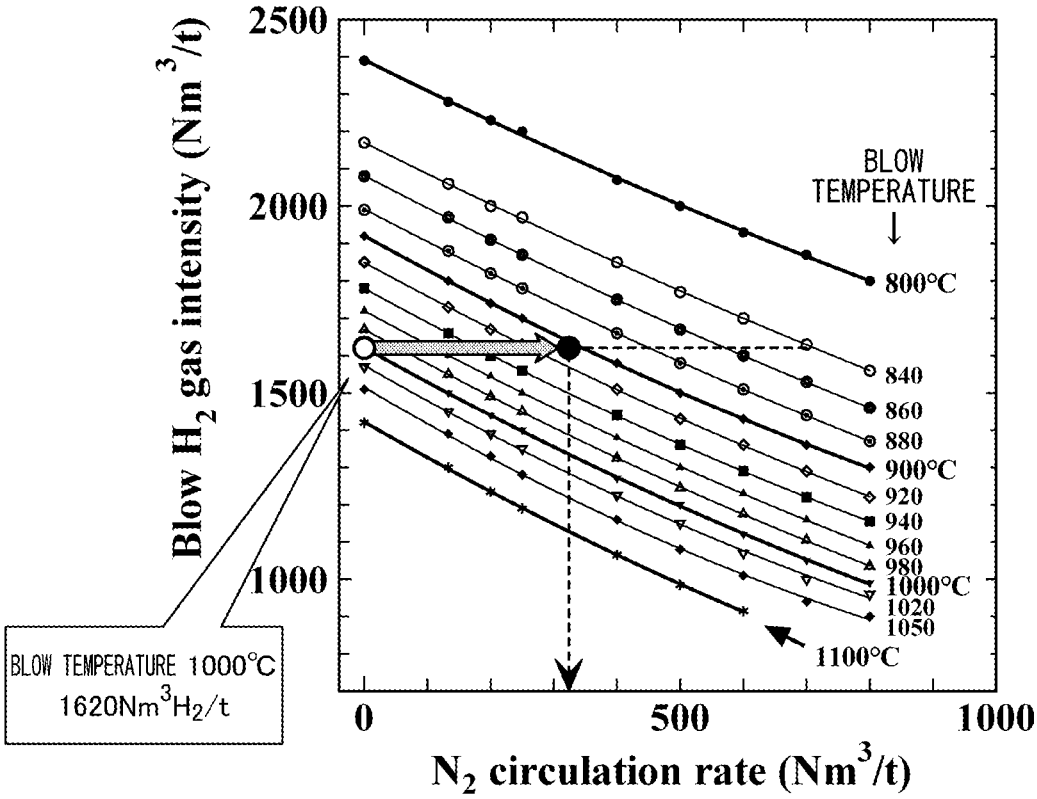
FIG. 4 is a graph showing the relationship between the amount of the nitrogen gas added and the hydrogen gas intensity for each blow temperature of the gas mixture.

Next, an effect from the viewpoint of the thermal efficiency will be described. FIG. 4 is the same graphs as FIG. 3 but shows the relationship between the amount of the nitrogen gas 32 added ($Nm^3$/t-Fe) and the hydrogen gas intensity ($Nm^3$/t-Fe) for a wider variety of blow temperatures. The blow temperatures of these graphs are 800° C., 840° C., 860° C., 880° C., 900° C., 920° C., 940° C., 960° C., 980° C., 1000° C., 1020° C., 1050° C. and 1100° C. from above. Simulation conditions at the time of obtaining FIG. 4 were set to be the same as those for FIG. 2 and FIG. 3. According to FIG. 4, for example, in a case where the blow temperature is 900° C. and the amount of the nitrogen gas 32 added becomes 330 $Nm^3$/t-Fe, the reduced iron 21 can be produced with the reduction degree of 100% by setting the amount of the reducing gas 31 (here, the hydrogen gas) blown in from the tuyere 10*c* to 1620 $Nm^3$/t-Fe.

Figure 5:
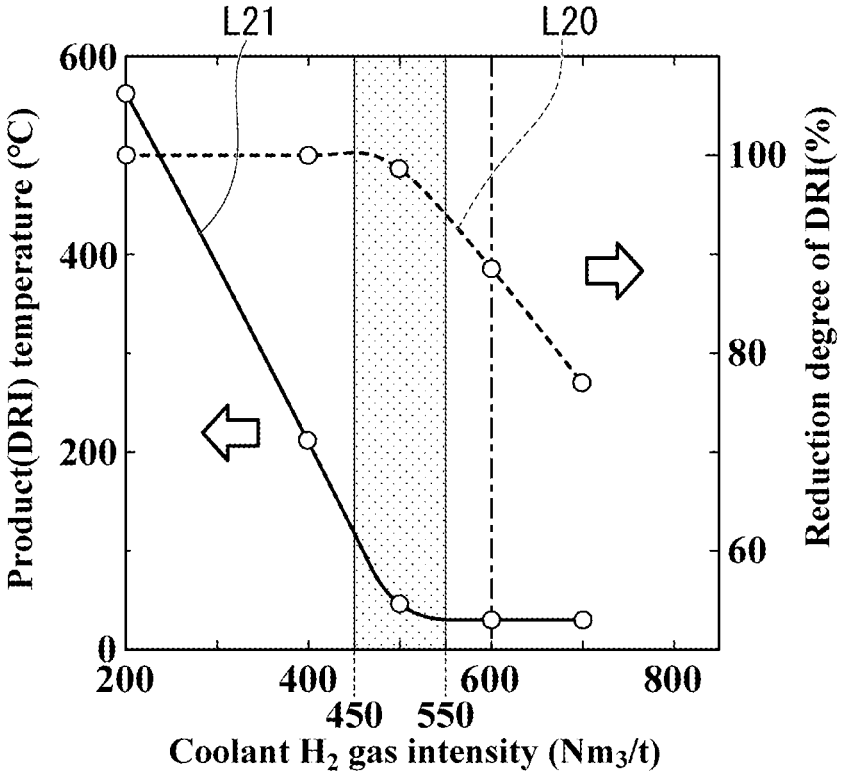
FIG. 5 is graphs showing a correlation among the intensity of a hydrogen gas that is blown into a cooling zone, the temperature and reduction degree of the reduced iron.

The present inventors simulated operation in which part of 1620 $Nm^3$/t-Fe of the reducing gas 31 is blown into the cooling zone 10*b* at normal temperature (here, 30° C.) and the reducing gas 31 that is flowing up in the cooling zone 10*b* is used for the reduction of the iron oxide raw material 20. The simulation was carried out using the above-described mathematical model, and the calculation conditions were set to be the same as in Table 1. The amount of the nitrogen gas 32 added was set to 330 $Nm^3$/t-Fe, the blow temperature was set to 900° C., and the hydrogen gas concentration of the reducing gas 31 was set to 100 volume %. The results are shown in FIG. 5. The horizontal axis of FIG. 5 indicates the blowing amount ($Nm^3$/t-Fe) of the reducing gas 31 into the cooling zone 10*b*, and the vertical axis indicates the temperature (° C.) or reduction degree (%) of the reduced iron 21 that is discharged from the lower portion of the shaft furnace 10. The graph L20 shows the correlation between the blowing amount ($Nm^3$/t-Fe) of the reducing gas 31 into the cooling zone 10*b* and the reduction degree (%) of the reduced iron 21, and the graph L21 shows the correlation between the blowing amount ($Nm^3$/t-Fe) of the reducing gas 31 into the cooling zone 10*b* and the temperature (° C.) of the reduced iron 21.

As shown in FIG. 5, the reduced iron 21 is reliably cooled to normal temperature by increasing the blowing amount ($Nm^3$/t-Fe) of the reducing gas 31 into the cooling zone 10*b*. However, when the blowing amount becomes excessively large, the reducing gas 31 is not sufficiently heated in the cooling zone 10*b*, the temperature of the reducing gas 31 in the reduction zone 10*a* drops, and the reduction degree of the reduced iron 21 may become less than 100%.

When actual shaft furnace operation is taken into account, the reduction degree of the reduced iron 21 that is discharged from the shaft furnace 10 becomes 100% (or a value close to 100%, for example, 95%) and the temperature of the reduced iron 21 is cooled to approximately normal temperature (for example, normal temperature to approximately normal temperature+30° C.). Therefore, in the example of FIG. 5, the blowing amount of the reducing gas 31 into the cooling zone 10*b* is preferably approximately 450 to 550 $Nm^3$/t-Fe (preferable range). In this case, the reduction degree of the reduced iron 21 can be set to 95% or more, and the temperature of the reduced iron 21 can be set to normal temperature (30° C.)+30° C. or lower. A more preferable blowing amount is 500 $Nm^3$/t-Fe. In this case, the reduction degree of the reduced iron 21 can be set to 100% or more, and the temperature of the reduced iron 21 can be set to normal temperature (30° C.). That is, it is possible to omit a heating treatment of 500 $Nm^3$/t-Fe of the reducing gas 31, which accounts for approximately 30% of the total blowing amount of the reducing gas 31 of 1620 $Nm^3$/t-Fe, without affecting the reduction efficiency in the reduction zone 10*a*.

Figure 6:
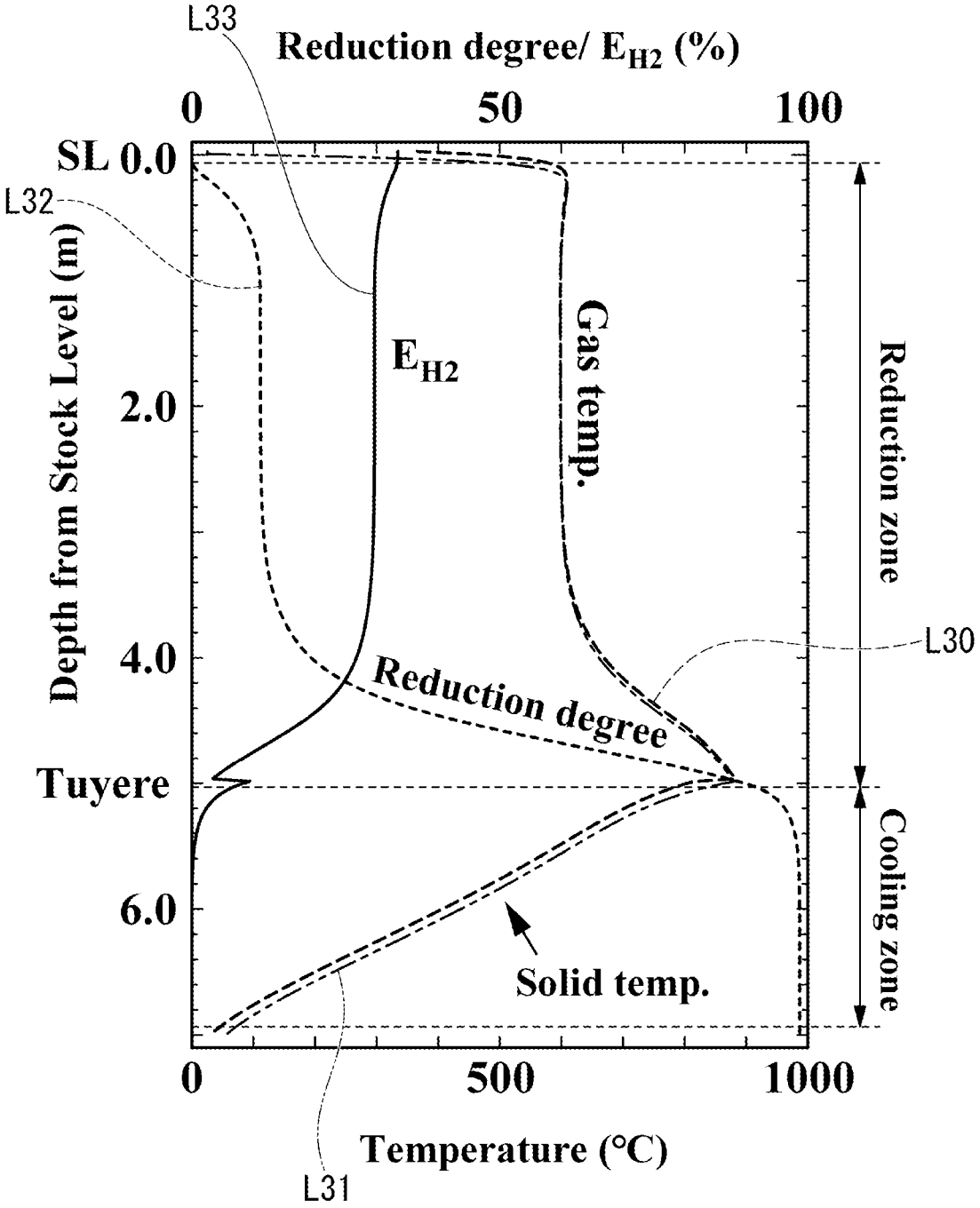
FIG. 6 is graphs showing the in-furnace state of a shaft furnace.

FIG. 6 shows the in-furnace state in a case where the above-described simulation has been carried out. The vertical axis of FIG. 6 indicates the depth (m) of the shaft furnace 10 from the upper end, and the horizontal axis indicates the temperature (° C.) of each component and the reduction degree (%) or $E_{H2}$ (%) of the reduced iron 21. Here, $E_{H2}$ indicates "hydrogen gas utilization ratio", which means the $H_2O/(H_2+H_2O)$ volume ratio in the gas; however, in the present simulation, since 100 volume % of a hydrogen gas is blown into the shaft furnace 10, $E_{H2}$ simply indicates the $H_2O$ concentration. The graph L30 indicates the temperature of the reducing gas 31 at each depth position in the shaft furnace 10. The graph L31 indicates the temperature of the reduced iron 21 (or the iron oxide raw material 20) at each depth position in the shaft furnace 10. The graph L32 indicates the reduction degree of the reduced iron 21 at each depth position in the shaft furnace 10. The graph L33 indicates $E_{H2}$ at each depth position in the shaft furnace 10. "Tuyere" indicates the installation position of the tuyere 10*c*. According to the graph L30, it is found that the reducing gas 31 blown into the cooling zone 10*b* flows up in the cooling zone 10*b* and is heated by the reduced iron 21 and, when reaching the tuyere level, the reducing gas 31 is heated up to approximately the same temperature as the temperature of the reducing gas 31 that is blown in from the tuyere 10*c* (=the temperature of the gas mixture 30). Therefore, it can be said that the iron oxide raw material 20 can be reduced without affecting the reduction efficiency in the reduction zone 10*a*. In addition, according to the graph L31, it is found that the temperature of the reduced iron 21 (or the iron oxide raw material 20) is approximately almost the same as the temperature of the reducing gas 31. In addition, it is found that the reduction degree of the reduced iron 21 becomes almost 100% on the tuyere level.

A preferable blowing amount of the reducing gas 31 that is blown into the cooling zone 10*b* may vary with operation conditions (for example, the blow temperature, the amount of the nitrogen gas 32 added and the like). Therefore, it is necessary to produce the same graph as FIG. 5 for each operation condition and specify the preferable blowing amount.

Therefore, when the reducing gas 31 at normal temperature is blown into the cooling zone 10*b*, it is possible to collect the sensible heat of the reduced iron 21, and the thermal efficiency improves. Furthermore, when the blowing amount of the reducing gas 31 into the cooling zone 10*b* is adjusted such that the reduction degree of the reduced iron 21 becomes 95% or more and the temperature of the reduced iron 21 becomes normal temperature (30° C.)+30° C. or lower, it is possible to improve the thermal efficiency without affecting the reduction efficiency (and the temperature of the reduced iron 21 to be discharged) in the reduction zone 10*a*.

1-1. First Modification Example

Figure 7:
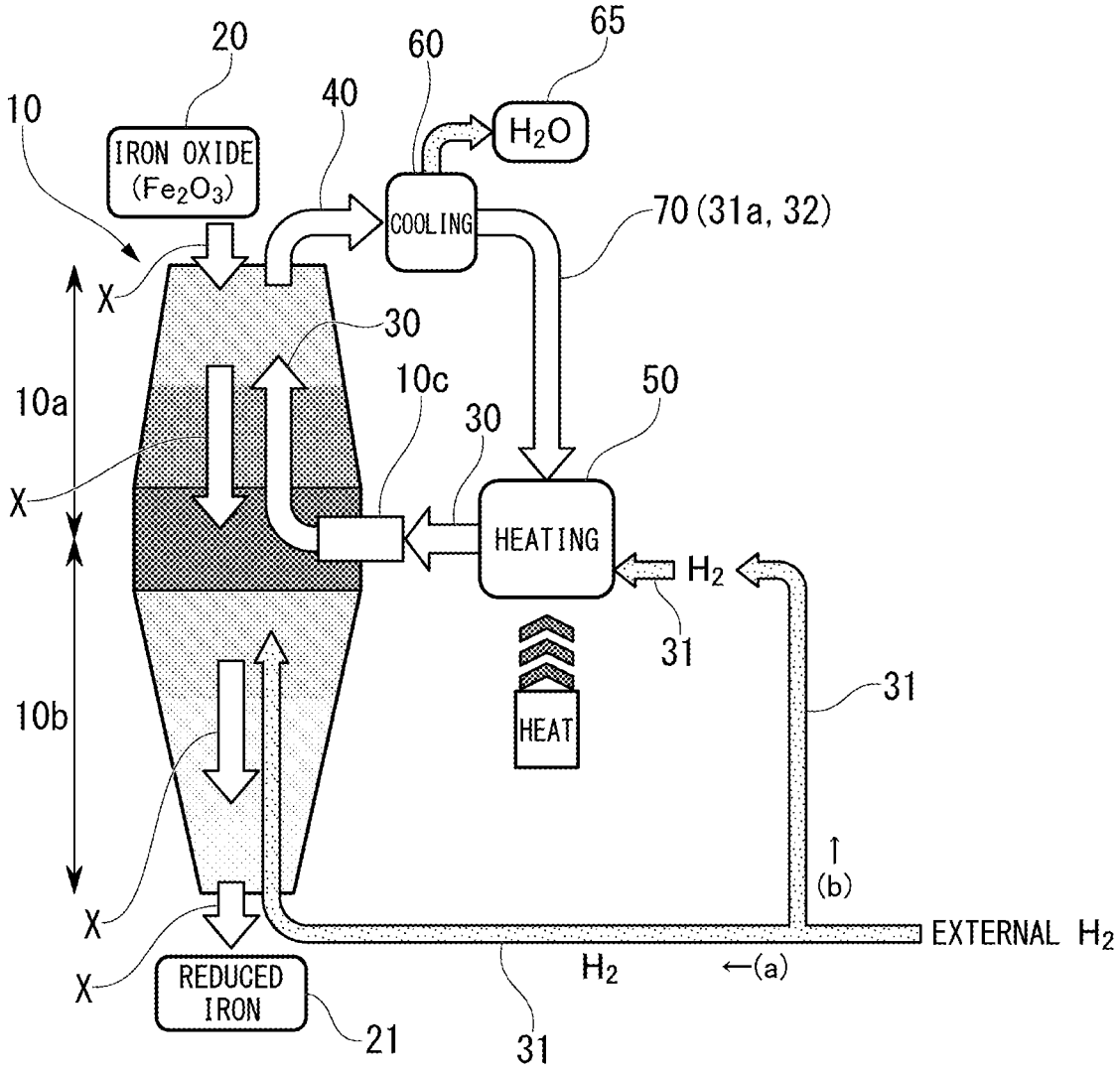
FIG. 7 is an explanatory view showing the process flow of a method for producing reduced iron according to a first modification example of the first embodiment.

Next, a first modification example of the first embodiment will be described based on FIG. 7. In actual shaft furnace operation, it is also important to effectively use the reducing gas 31 and the nitrogen gas 32. Therefore, in the first modification example, an unreacted hydrogen gas 31*a* and the nitrogen gas 32 are separated and collected from the furnace top gas 40 and reused as part of the gas mixture 30.

Specifically, the furnace top gas 40 is introduced into a separation and collection device 60, and the furnace top gas 40 is cooled in the separation and collection device 60. The furnace top gas 40 is preferably cooled to room temperature. Furthermore, it is preferable to remove dust from the furnace top gas 40. This removes water vapor from the furnace top gas 40 as water 65 and separates and collects the unreacted hydrogen gas 31*a* and the nitrogen gas 32 as a circulation gas 70. In a case where the reducing gas 31 contains a reducing gas other than a hydrogen gas (CO or the like), the circulation gas 70 may contain not only the reducing gas that is unreacted but also an oxide of the reducing gas ($CO_2$ or the like), and there is no problem with operation even when the circulation gas 70 contains these gases. As the separation and collection device 60, it is possible to use, for example, a device or the like that separates and collects an unreacted reducing gas from a furnace top gas of a blast furnace. In addition, the circulation gas 70 is reused as part of the gas mixture 30. That is, the circulation gas 70 is, again, introduced into the heating furnace 50 and heated.

As described above, the nitrogen gas 32 functions as a carrier that carries sensible heat into the shaft furnace 10 and is thus not consumed in the shaft furnace 10. Therefore, the nitrogen gas 32 circulates in a circulation system that couples the heating furnace 50, the shaft furnace 10 and the separation and collection device 60. Therefore, once a necessary amount of the nitrogen gas 32 for the production of a desired amount of reduced iron is introduced into this circulation system, theoretically, there is no need to introduce the nitrogen gas 32 from the outside afterwards. The nitrogen gas 32 may be further supplied from the outside.

On the other hand, since the reducing gas 31 is consumed in the shaft furnace 10, only the circulated hydrogen gas 31*a* cannot make the reducing gas 31 sufficient. Therefore, the reducing gas 31 is supplied from the outside for compensating the insufficiency. Theoretically, this makes it possible to produce the reduced iron 21 with the stoichiometrically minimum amount of the reducing gas 31. The reducing gas 31 may be supplied from the outside more than the stoichiometric amount.

In a case where the hydrogen gas concentration of the reducing gas 31 becomes 100 volume %, according to the formula (1), the stoichiometrically minimum amount of the reducing gas 31 becomes 600 $Nm^3$/t-Fe. Therefore, for example, in the case of carrying out operation under the operation conditions under which FIG. 5 is obtained, it is preferable to blow, for example, 500 $Nm^3$/t-Fe of the reducing gas 31 (here, the hydrogen gas) into the cooling zone 10*b* from the outside and to supply the remaining 100 $Nm^3$/t-Fe of the reducing gas 31 to the heating furnace 50 from the outside. In this case, the reduction degree of the reduced iron 21 can be set to 100% or more with the stoichiometrically minimum amount of the reducing gas 31, and the temperature of the reduced iron 21 can be set to normal temperature (30° C.).

In this case, since it is necessary to blow a total of 1620 $Nm^3$/t-Fe of the reducing gas 31 into the shaft furnace 10 (refer to FIG. 4), 1120 $Nm^3$/t-Fe of the reducing gas 31 is blown in from the tuyere 10*c*. Since 100 $Nm^3$/t-Fe of the reducing gas 31 is supplied from the outside, the remaining 1020 $Nm^3$/t-Fe of the reducing gas 31 is covered by the reducing gas 31 that is circulated.

As described above, according to the first modification example, it is possible to effectively use the reducing gas 31 and the nitrogen gas 32.

1-2. Second Modification Example

Figure 8:
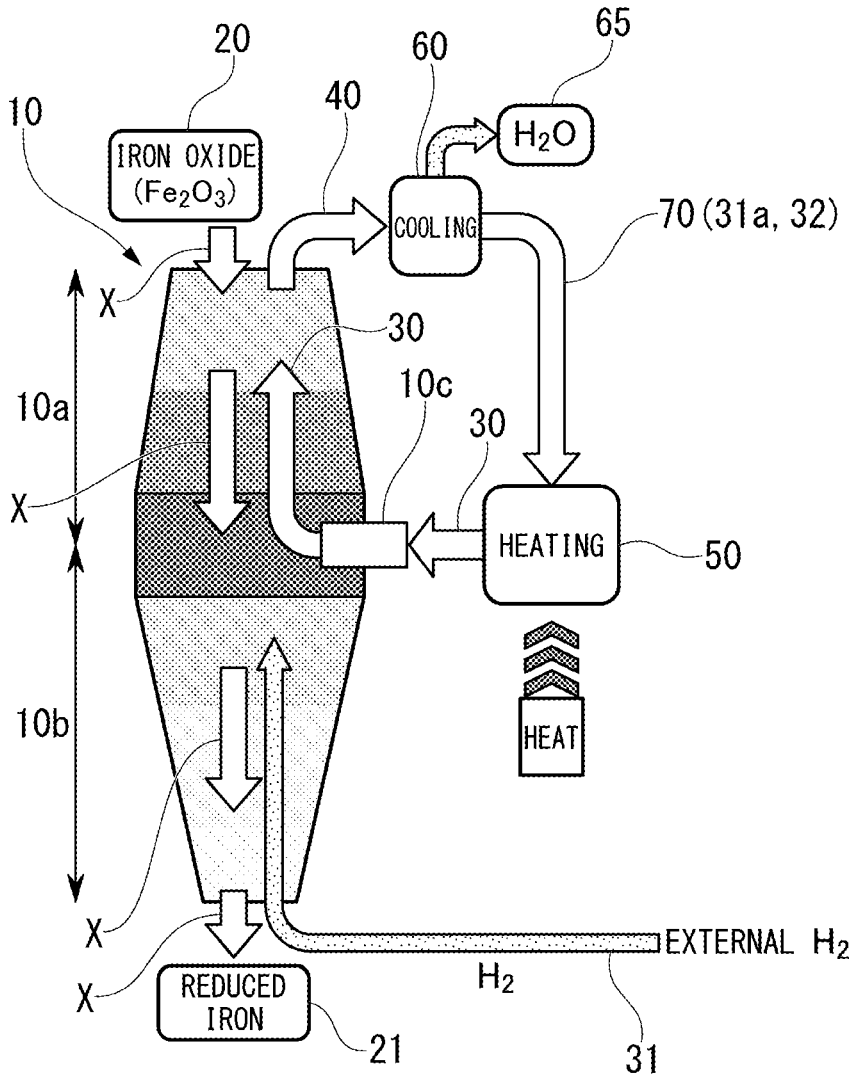
FIG. 8 is an explanatory view showing the process flow of a method for producing reduced iron according to a second modification example of the first embodiment.

Next, a second modification example of the first embodiment will be described based on FIG. 8. In the second modification example as well, similar to the first modification example, the unreacted hydrogen gas 31*a* and the nitrogen gas 32 are separated and collected from the furnace top gas 40 and reused as part of the gas mixture 30. However, in the second modification example, the reducing gas 31 that is supplied from the outside is fully blown into the cooling zone 10*b*. That is, the supply line (b) is omitted. The blowing amount of the reducing gas 31 into the cooling zone 10*b* is, for example, the above-described stoichiometric lower limit value of 600 $Nm^3$/t-Fe. The reducing gas 31 blown into the cooling zone 10*b* cools the reduced iron 21 while flowing up in the cooling zone 10*b* (the reducing gas 31 itself is heated). In addition, the heated reducing gas 31 reduces the iron oxide raw material 20 in the reduction zone 10*a*.

As described above, in a system where the furnace top gas 40 is circulated as in the first modification example, theoretically, the stoichiometrically minimum amount of the reducing gas 31 needs to be supplied from the outside. For example, in the case of applying the operation conditions under which FIG. 5 is obtained as they are to the first modification example (FIG. 7), it is necessary to blow, for example, 500 $Nm^3$/t-Fe of the reducing gas 31 (here, the hydrogen gas) into the cooling zone 10*b* from the outside and to supply the remaining 100 $Nm^3$/t-Fe of the reducing gas 31 to the heating furnace 50 from the outside.

If it is possible to fully blow the reducing gas 31 that is supplied from the outside into the cooling zone 10*b* at normal temperature, the thermal efficiency further improves, and, furthermore, the supply line (b) can also be omitted, which is extremely advantageous in terms of operation.

However, as shown in FIG. 5, simply when the reducing gas 31 that is supplied from the outside is fully blown into the cooling zone 10*b* at normal temperature, there is a concern of a decrease in the reduction degree of the reduced iron 21. In order to fully blow the reducing gas 31 that is supplied from the outside into the cooling zone 10*b* at normal temperature while maintaining the reduction degree of the reduced iron 21 at 95% or more, it is preferable that, for example, a preferable range of the blowing amount as shown in FIG. 5 (a preferable range of the blowing amount of the reducing gas 31 into the cooling zone 10*b*, 450 to 550 $Nm^3$/t-Fe in the example of FIG. 5) can be shifted to the right such that the preferable range includes the stoichiometric lower limit value of 600 $Nm^3$/t-Fe.

By the way, the reason for the above-described preferable range being determined is that, when the reducing gas 31 is excessively blown into the cooling zone 10*b*, the temperature of the reduction zone 10*a* drops and the reduction degree of the reduced iron 21 decreases. Therefore, if it is possible to compensate for such a temperature drop with separate means, it is possible to increase the blowing amount of the reducing gas 31 into the cooling zone 10*b*, and, furthermore, it is possible to include the stoichiometric value in the preferable range of the blowing amount. As such means, the present inventors paid attention to an increase in the amount of the nitrogen gas 32 added (in other words, the amount of the nitrogen gas 32 circulating in the circulation system including the shaft furnace 10).

Figure 9:
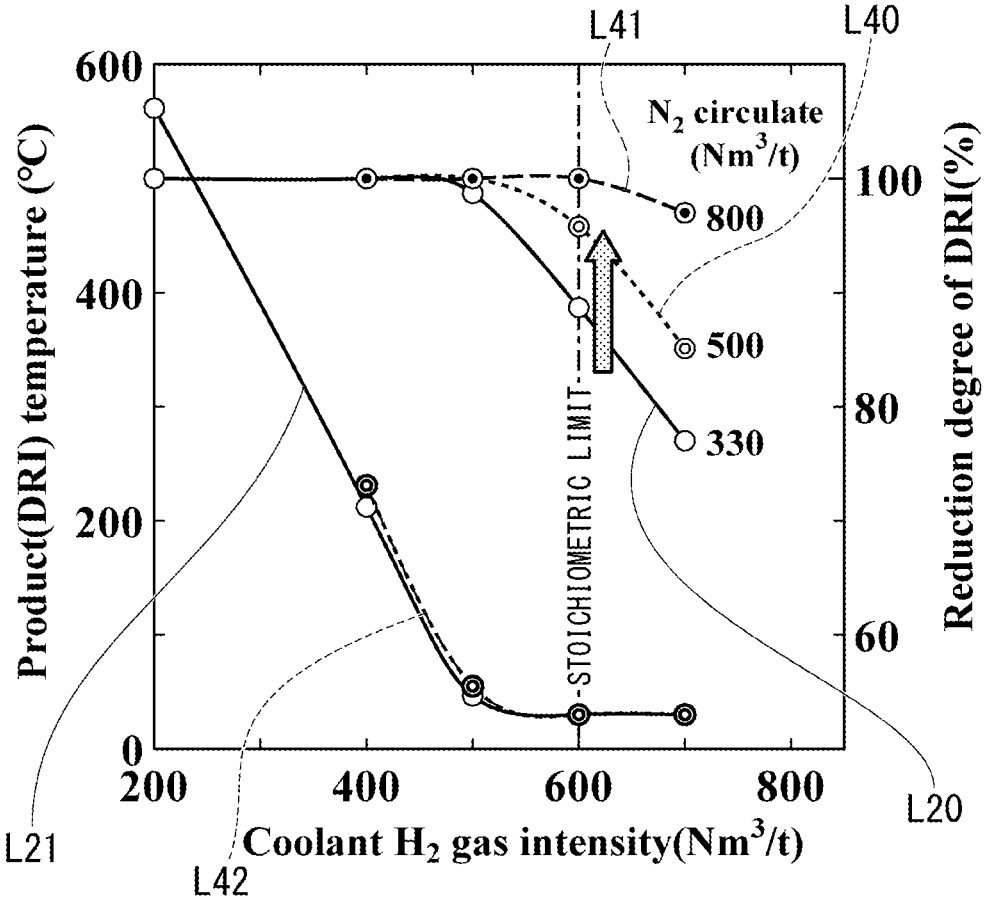
FIG. 9 is a graph showing a correlation among the intensity of a hydrogen gas that is blown into a cooling zone, the temperature and reduction degree of the reduced iron for each amount of a nitrogen gas added.

For example, in a case where the amount of the nitrogen gas 32 added is added under the operation conditions of FIG. 5, the graphs shown in FIG. 9 are obtained. The graph L40 indicates the correlation between the blowing amount ($Nm^3$/t-Fe) of the reducing gas 31 into the cooling zone 10*b* and the reduction degree (%) of the reduced iron 21 in a case where the amount of the nitrogen gas added becomes 500 $Nm^3$/t-Fe. The graph L41 indicates the correlation between the blowing amount ($Nm^3$/t-Fe) of the reducing gas 31 into the cooling zone 10*b* and the reduction degree (%) of the reduced iron 21 in a case where the amount of the nitrogen gas added becomes 800 $Nm^3$/t-Fe. The graph L42 indicates the correlation between the blowing amount ($Nm^3$/t-Fe) of the reducing gas 31 into the cooling zone 10*b* and the temperature (° C.) of the reduced iron 21 in a case where the blowing amount of the nitrogen gas becomes 800 $Nm^3$/t-Fe.

According to FIG. 9, the reduction degree of the reduced iron 21 with respect to the blowing amount of the reducing gas 31 into the cooling zone 10*b* can be increased by changing the blowing amount of the nitrogen gas 32 like 330→500→800 $Nm^3$/t-Fe. That is, when the blowing amount of the nitrogen gas 32 is set to 500 $Nm^3$/t-Fe, it is possible to set the reduction degree of the reduced iron 21 at the time of having blown 600 $Nm^3$/t-Fe of the reducing gas 31 into the cooling zone 10*b* to 95%. Furthermore, when the blowing amount of the nitrogen gas 32 is set to 800 $Nm^3$/t-Fe, it is possible to set the reduction degree of the reduced iron 21 at the time of having blown 600 $Nm^3$/t-Fe of the reducing gas 31 into the cooling zone 10*b* to 100%. As described above, an increase in the amount of the nitrogen gas 32 added makes it possible to include the stoichiometric value in the preferable range of the blowing amount. That is, when the amount of the nitrogen gas 32 added is set to 500 $Nm^3$/t-Fe, it is possible to set the reduction degree of the reduced iron 21 to 95% or more even when the stoichiometric value of the reducing gas 31 is fully blown into the cooling zone 10*b*. When the amount of the nitrogen gas 32 added is set to 800 $Nm^3$/t-Fe, it is possible to set the reduction degree of the reduced iron 21 to 100%. The stoichiometric value or more of the reducing gas 31 may be blown into the cooling zone 10*b*; however, in this case, it is preferable to further increase the amount of the nitrogen gas 32 added and maintain the reduction degree of the reduced iron 21 at 95% or more and preferably 100%.

A preferable amount of the nitrogen gas 32 added varies with the operation conditions. Therefore, it is preferable to produce graphs as shown in FIG. 9 for each operation condition and specify the preferable amount of the nitrogen gas 32 added. That is, even when the stoichiometric value (or more) of the reducing gas 31 is blown into the cooling zone 10*b*, the amount of the nitrogen gas 32 added at which the reduction degree of the reduced iron 21 can be maintained at 95% or more may be adjusted.

As described above, according to the second modification example, the adjustment of the amount of the nitrogen gas 32 added makes it possible to fully blow the reducing gas 31 from the outside into the cooling zone 10*b* and, furthermore, makes it possible to set the reduction degree of the reduced iron 21 to 95% or more and preferably 100%.

2. Second Embodiment

Figure 10:
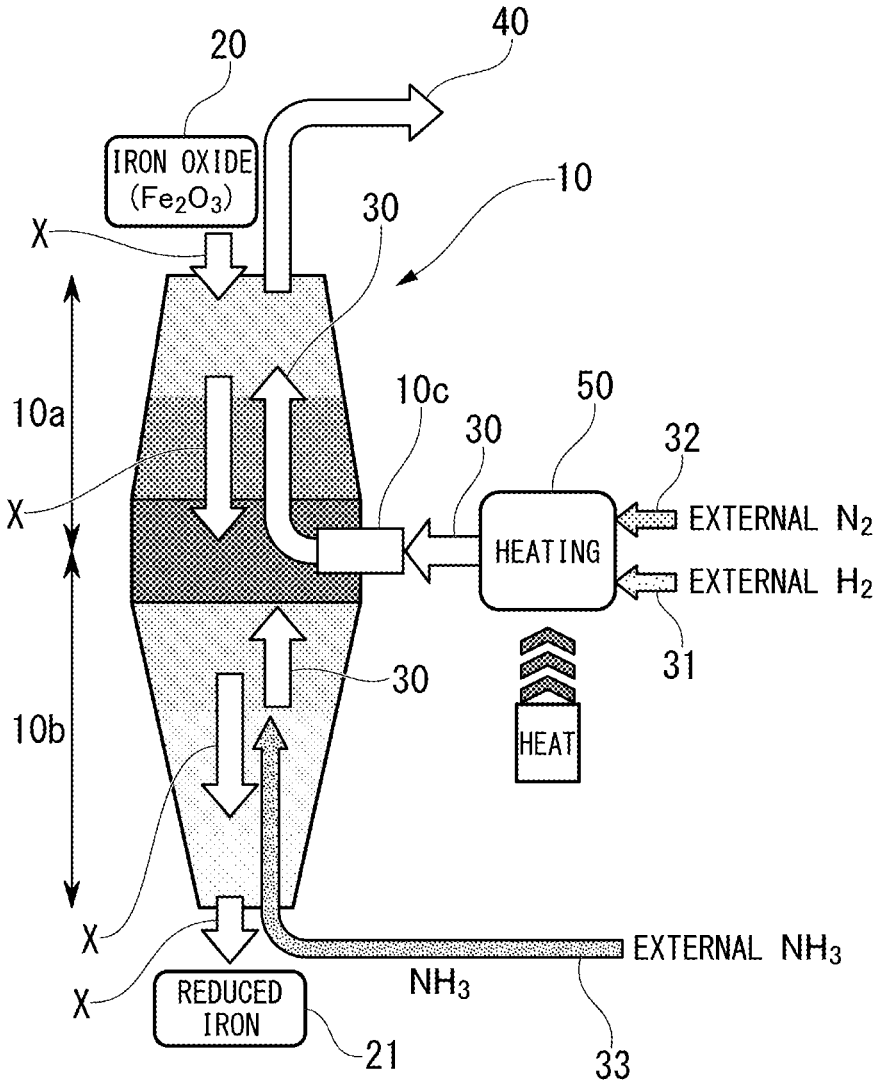
FIG. 10 is an explanatory view showing the process flow of a method for producing reduced iron according to a second embodiment.

Next, a second embodiment of the present disclosure will be described. FIG. 10 is an explanatory view showing the process flow of a method for producing reduced iron according to the second embodiment. As shown in FIG. 10, in the second embodiment, schematically, an ammonia gas 33 is blown into the cooling zone 10*b* instead of the reducing gas 31. The ammonia gas 33 is blown into the cooling zone 10*b* at normal temperature. That is, in the second embodiment, the ammonia gas 33 is used as a hydrogen gas supply source.

In more detail, the ammonia gas is industrially produced in large quantities as a chemical fertilizer and also can be easily liquefied and thus can be said as a hydrogen carrier having excellent portability. The fact that ammonia can be used for the reduction of iron oxide is shown in Patent Document 1 and Non Patent Document 2. However, in these documents, the basic phenomenon was simply verified in laboratories, and no specific process images were shown. The present inventors paid attention not to the fact that ammonia is capable of directly reducing iron oxide but to the fact that reduced iron serves as a catalyst and ammonia is decomposed (formula (a)).

[Chem. 1]

$$NH_3 \rightarrow \frac{1}{2}N_2 + \frac{3}{2}H_2 \tag{a}$$

In the shaft furnace 10, a countercurrent moving bed is formed (that is, the reducing gas 31 and the nitrogen gas 32 flow up in the shaft furnace 10, and the iron oxide raw material 20 and the reduced iron 21 descends in the shaft furnace 10). Therefore, when the ammonia gas 33 is blown in from the cooling zone 10*b*, the ammonia gas 33 can be decomposed with the reduced iron 21 serving as a catalyst while flowing up in the shaft furnace 10. In more detail, the ammonia gas 33 blown into the cooling zone 10*b* cools the reduced iron 21 while flowing up in the cooling zone 10*b*. Accordingly, the ammonia gas 33 is heated by the sensible heat of the reduced iron 21. After that, the ammonia gas 33 is decomposed into a nitrogen gas and a hydrogen gas with the reduced iron 21 serving as a catalyst. That is, the decomposition reaction of the ammonia gas 33 is an endothermic reaction, but heat necessary for the decomposition reaction is supplied from the reduced iron 21. In addition, the reduced iron 21 itself serves as a catalyst to accelerate the decomposition of the ammonia gas. The nitrogen gas 32 and the hydrogen gas, that is, the gas mixture 30, generated by the decomposition of the ammonia gas 33 flow up while being heated by the sensible heat of the reduced iron 21 and reach the tuyere level. The gas mixture 30 has been heated up to, for example, the blow temperature level when reached the tuyere level. This gas mixture 30, similar to the gas mixture 30 blown in from the tuyere 10*c*, flows up in the reduction zone 10*a* and reduces the iron oxide raw material 20 in the reduction zone 10*a*. That is, the hydrogen gas and the nitrogen gas 32 generated by the decomposition of the ammonia gas 33 while flowing up in the cooling zone 10*b* are used as part of the gas mixture 30. Therefore, the blowing of the ammonia gas 33 into the cooling zone 10*b* makes it possible to use the ammonia gas 33 as a hydrogen gas supply source and also makes it possible to improve the thermal efficiency. Furthermore, part of the reducing gas 31 that is supplied from the outside (mainly a hydrogen gas) can be replaced by the ammonia gas 33, which makes it possible to reduce the amount of the reducing gas 31 supplied from the outside.

Next, an effect of the second embodiment will be studied in detail. The equilibrium constant Kp in the formula (a) is defined by the following formula (b). The hydrogen gas concentration of the reducing gas 31 was set to 100 volume %.

[Math. 1]

$$K_p \equiv \frac{p_{N2}^{1/2} \cdot p_{H2}^{3/2}}{p_{NH3}} = \exp\left[-\frac{\Delta G^0(T)}{RT}\right] \tag{b}$$

Here, $P_{NH3}$, $P_{H2}$ and $P_{N2}$ each indicate the partial pressure of the ammonia gas, the hydrogen gas and the nitrogen gas, T indicates the reaction temperature, and R is the gas constant. In addition, $\Delta G^0$ (T) is the standard free energy of the decomposition reaction of the ammonia gas 33 and can be calculated based on the thermochemical data of the ammonia gas, the hydrogen gas and the nitrogen gas.

Figure 11:
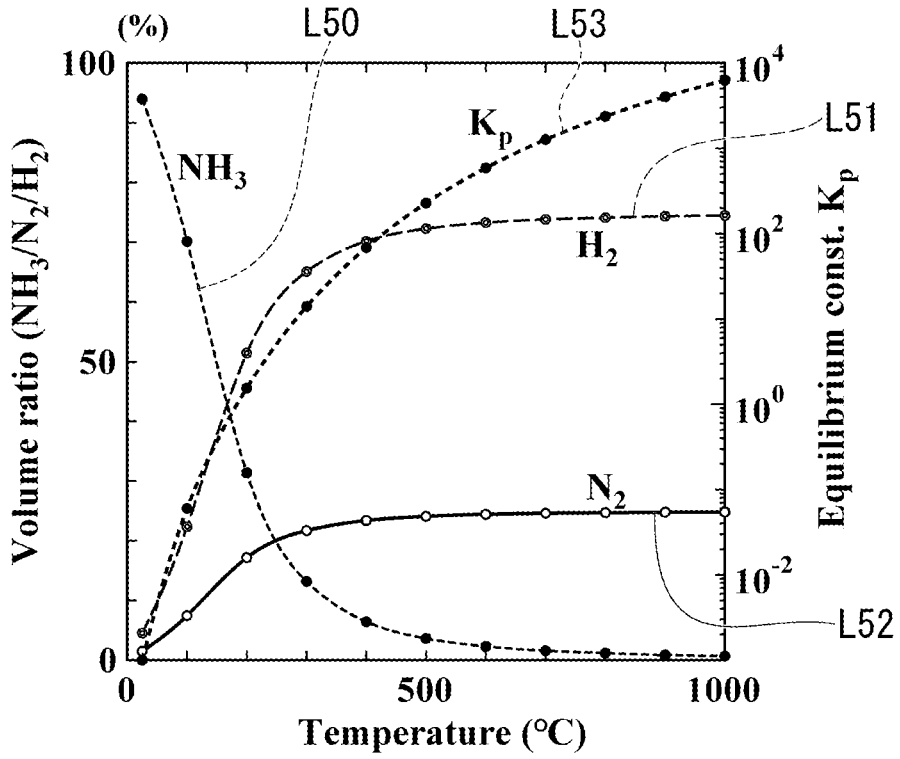
FIG. 11 is a graph showing a correlation among the reaction temperature at the time of decomposing an ammonia gas into a nitrogen gas and a hydrogen gas, the volume ratio and equilibrium constant of each gas.

The evaluation results of the decomposition ratio of the ammonia gas and the generation ratio of hydrogen in an equilibrium state with respect to the reaction temperature are FIG. 11. The horizontal axis of FIG. 11 indicates the reaction temperature, and the vertical axis indicates the volume ratio (the volume of each gas/the total volume of all gases) or equilibrium constant Kp of each gas. The graph L50 indicates the volume ratio of the ammonia gas at each reaction temperature, the graph L51 indicates the volume ratio of the hydrogen gas at each reaction temperature and the graph L52 indicates the volume ratio of the nitrogen gas at each reaction temperature. The graph L53 indicates the equilibrium constant Kp at each reaction temperature.

According to FIG. 11, almost all of the ammonia gas can be decomposed into a hydrogen gas and a nitrogen gas at reaction temperatures of 600° C. or higher. In addition, in the shaft furnace 10, the reduced iron catalyst satisfying this temperature condition is present in the cooling zone 10*b*, for example, as shown in FIG. 6. Therefore, in a case where the ammonia gas 33 has been blown into the cooling zone 10*b*, the ammonia gas 33 can be decomposed into a hydrogen gas and the nitrogen gas 32 in the cooling zone 10*b*.

Therefore, in consideration of the fact that this decomposition reaction is an endothermic reaction (ΔH=46110 J/mol/K), the amount of an ammonia gas that can be blown into the cooling zone 10*b* was simulated based on the heat and mass balance in the cooling zone 10*b* under the prerequisites of (1) the ammonia gas 33 completely decomposes in the cooling zone 10*b*, (2) heat exchange between the reduced iron 21 and the ammonia gas 33 in the cooling zone 10*b* proceeds ideally and (3) the in-furnace state of the reduction zone 10*a* is not affected (that is, the temperature of the gas mixture 30 generated by the decomposition reaction on the outlet side (tuyere level) of the cooling zone 10*b* approximately coincides with the blow temperature and the reduction degree of the reduced iron 21 becomes 100% on the tuyere level). The simulation was carried out using the above-described mathematical model, and the calculation conditions were set to be the same as in Table 1. The amount of the nitrogen gas 32 added was set to 330 $Nm^3$/t-Fe, and the hydrogen gas concentration of the reducing gas 31 that was supplied from the outside was set to 100 volume %. The results are shown in FIG. 12.

Figure 12:
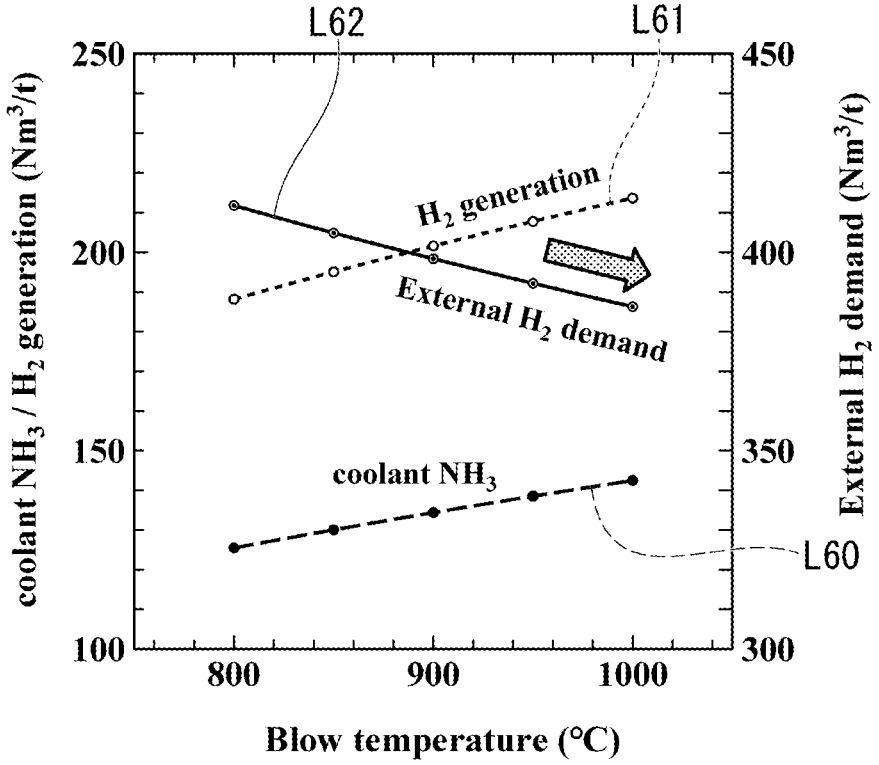
FIG. 12 is graphs showing a correlation among the blow temperature of a gas mixture, the intensity of the ammonia gas that is blown into a cooling zone, the intensity of the hydrogen gas that is generated by the decomposition of the ammonia gas and the intensity of a hydrogen gas that is blown into from the outside.

The horizontal axis of FIG. 12 indicates the blow temperature of the gas mixture 30 that is blown into the shaft furnace 10 from the tuyere 10*c*, and the vertical axis indicates the intensity ($Nm^3$/t-Fe) of the ammonia gas 33 that can be blown into the cooling zone 10*b* (that is, can be decomposed in the cooling zone 10*b*), the intensity ($Nm^3$/t-Fe) of a hydrogen gas that is generated by the decomposition of the ammonia gas 33 or the intensity ($Nm^3$/t-Fe) of the reducing gas 31 (here, the hydrogen gas) that is supplied from the outside. The graph L60 indicates the correlation between the intensity ($Nm^3$/t-Fe) of the ammonia gas 33 that can be blown into the cooling zone 10*b* and the blow temperature, and the graph L61 indicates the correlation between the intensity ($Nm^3$/t-Fe) of the hydrogen gas that is generated by the decomposition of the ammonia gas 33 and the blow temperature. The graph L62 indicates the correlation between the intensity ($Nm^3$/t-Fe) of the reducing gas 31 (here, the hydrogen gas) that is supplied from the outside and the blow temperature.

As shown in FIG. 12, since the amount of the ammonia gas that can be decomposed in the cooling zone 10*b* is proportional to sensible heat that is taken by the reduced iron 21, as the blow temperature becomes higher, the amount of the decomposable ammonia gas increases (that is, the amount of the ammonia gas that can be blown into the cooling zone 10*b* increases), and the hydrogen gas that is generated by the decomposition of the ammonia gas 33 increases. Accordingly, the amount of the hydrogen gas that is supplied from the outside decreases. Since approximately 200 $Nm^3$/t-Fe of a hydrogen gas is generated by the decomposition of the ammonia gas 33, if there is no heat loss from the furnace wall, approximately 30% of the minimum amount (600 $Nm^3$/t-Fe) of the hydrogen gas necessary for reduction can be covered by the decomposition of the ammonia gas 33.

The amount of the ammonia gas that can be blown into the cooling zone 10*b* can vary with each operation condition, but the amount of the ammonia gas is preferably determined such that the reduction degree of the reduced iron 21 becomes 95% or more and preferably 100%.

According to the second embodiment, the blowing of the ammonia gas 33 into the cooling zone 10*b* makes it possible to use the ammonia gas 33 as a hydrogen gas supply source and also makes it possible to improve the thermal efficiency. Furthermore, part of the reducing gas 31 that is supplied from the outside (mainly a hydrogen gas) can be replaced by the ammonia gas 33, which makes it possible to reduce the amount of the reducing gas 31 supplied from the outside.

2-1. Modification Example

Figure 13:
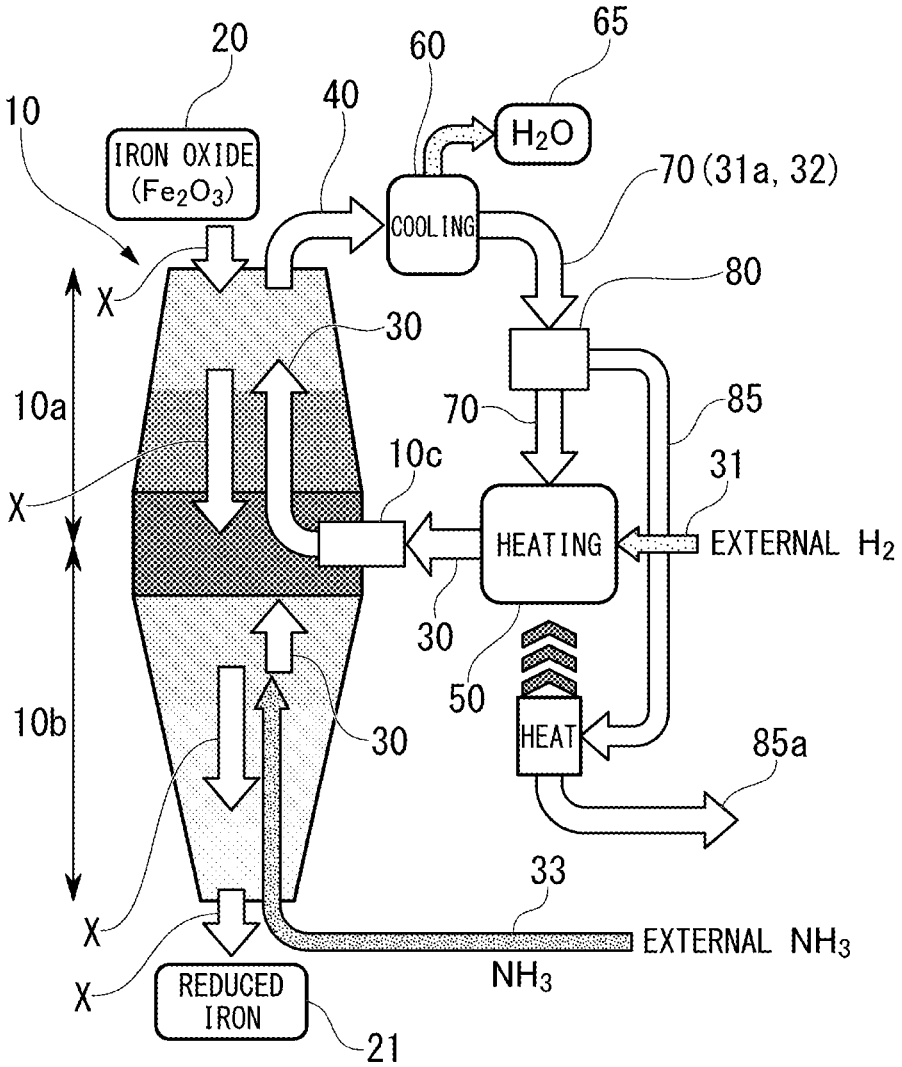
FIG. 13 is an explanatory view showing the process flow of a method for producing reduced iron according to a modification example of the second embodiment.
Figure 14:
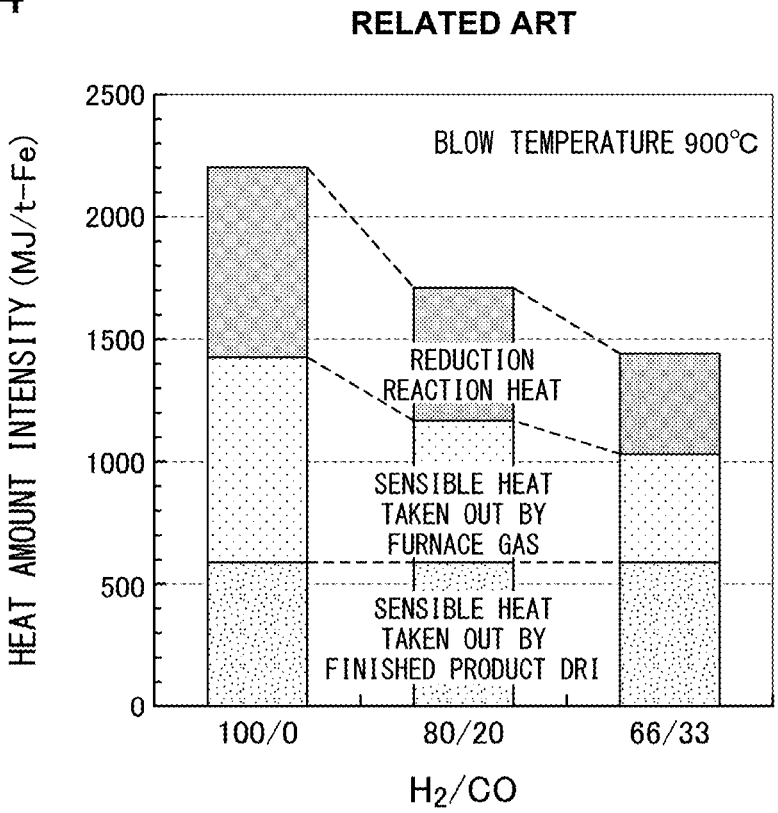
FIG. 14 is a graph showing the trial calculation result of the heat amount intensity (MJ/t-Fe) at the time of producing one ton of reduced iron using a reducing gas (900° C.) for each $H_2$/CO volume ratio of the reducing gas.

Next, a modification example of the second embodiment will be described based on FIG. 13. The present modification example is schematically a combination of the first modification example of the first embodiment and the second embodiment. That is, in the present modification example, the unreacted hydrogen gas 31*a* and the nitrogen gas 32 are separated and collected from the furnace top gas 40 and reused as part of the gas mixture 30 in the second embodiment.

However, in the present modification example, since the ammonia gas-derived nitrogen gas 32 flows into the system, it is necessary to steadily exhaust the nitrogen gas as much as the inflow amount to hold the amount of the nitrogen gas that circulates in the system to be constant.

Therefore, in the present modification example, the circulation gas 70 separated and collected with the separation and collection device 60 is introduced into a branching pipe 80. In the branching pipe 80, part of the circulation gas 70 is supplied to the heating furnace 50 as a fuel gas 85 in the heating furnace 50 (in a state of containing the hydrogen gas). The amount of the nitrogen gas 32 that is contained in the fuel gas 85 is set to be approximately the same as the amount of the nitrogen gas 32 that has flowed into the system due to the decomposition of the ammonia gas 33 (that is, ½ of the volume of the ammonia gas blown into the cooling zone 10*b*). The amount of the nitrogen gas 32 in the fuel gas 85 can be found by, for example, the measurement of the flow rate (generally, volume flow rate) of the fuel gas and the analysis of the nitrogen gas. The heating furnace 50 generates heat by combusting the fuel gas 85 and heats the gases in the heating furnace 50 with this heat. A combusted exhaust gas 85*a* (containing water vapor and the nitrogen gas 32) is dissipated to the outside. The rest of the circulation gas 70 is reused as part of the gas mixture 30. That is, the circulation gas 70 is, again, introduced into the heating furnace 50. Other treatments are the same as those in the first modification example of the first embodiment and the second embodiment. This makes it possible to obtain the same effects as those of the first modification example of the first embodiment and the second embodiment while holding the amount of the nitrogen gas that circulates in the system to be constant.

Furthermore, from the viewpoint of avoiding the inhibition of reduction by the excessive injection of the nitrogen gas 32, which has been mentioned in the above paragraphs, the rate of the amount of the nitrogen gas that circulates in the system with respect to the reducing gas 31 is desirably maintained in the appropriate range shown in FIG. 19.

In the above-described examples, the reducing gas 31 and the nitrogen gas 32 are heated together, but the present disclosure is not limited to such examples. For example, the reducing gas 31 and the nitrogen gas 32 may be separately heated, then, mixed and blown into the shaft furnace 10 from the tuyere 10*c*. In this case, it is preferable to set the heating temperature of the nitrogen gas 32 than the heating temperature of the reducing gas 31. This makes it possible to reduce the heating load of the reducing gas 31.

Hitherto, the preferred embodiments of the present disclosure have been described in detail with reference to the accompanying drawings, but the present disclosure is not limited to such examples. It is evident that a person skilled in the art of the present disclosure is able to consider a variety of modification examples or correction examples within the scope of the technical concept described in the claims, and such examples are understood to be in the technical scope of the present disclosure.

BRIEF DESCRIPTION OF THE REFERENCE SYMBOLS

10 Shaft furnace
10*a* Reduction zone
10*b* Cooling zone
20 Iron oxide raw material
30 Gas mixture
31 Reducing gas
32 Nitrogen gas
33 Ammonia gas
40 Furnace top gas
50 Heating furnace
60 Separation and collection device
70 Circulation gas
80 Branching pipe
85 Fuel gas

The invention claimed is:

1. A method for producing reduced iron that produces reduced iron by reducing iron oxide charged in a shaft furnace, wherein all of a reducing gas supplied from outside is blown into a cooling zone of the reduced iron provided at a lower portion of the shaft furnace at normal temperature, a heated gas mixture which contains a reducing gas which is an unreacted gas and a nitrogen gas, separated from a furnace top, is blown into the shaft furnace from a tuyere equipped at a lower portion of a reduction zone of the shaft furnace, the reducing gas supplied from the outside contains 90 volume % or more of a hydrogen gas, a lower limit value of a blowing amount of the reducing gas blown into the cooling zone is 600 $Nm^3$/t-Fe, the reducing gas that has flowed up in the cooling zone is used for reduction of the iron oxide, at least the hydrogen gas which is the unreacted gas and the nitrogen gas are separated and collected from a top gas of the shaft furnace, the separated and collected hydrogen gas and nitrogen gas are used as the gas mixture, and a blowing amount of the nitrogen gas blown into the shaft furnace from the tuyere equipped at the lower portion of the reduction zone is 330 $Nm^3$/t-Fe or more and 800 $Nm^3$/t-Fe or less.

2. A method for producing reduced iron that produces reduced iron by reducing iron oxide charged in a shaft furnace, wherein a heated gas mixture which contains a reducing gas which is an unreacted gas and a nitrogen gas, separated from a furnace top, is blown into the shaft furnace from a tuyere equipped at a lower portion of a reduction zone of the shaft furnace, an ammonia gas is blown into a cooling zone of the reduced iron provided at a lower portion of the shaft furnace at normal temperature, a hydrogen gas and a nitrogen gas generated by decomposition of the ammonia gas while flowing up in the cooling zone are used as part of the gas mixture, at least the hydrogen gas which is the unreacted gas and the nitrogen gas is separated and collected from a top gas of the shaft furnace, a part of the separated and collected hydrogen gas and nitrogen gas are used as the gas mixture, and a rest is used as a fuel gas at a time of heating the gas mixture, and the amount of the nitrogen gas that circulates in the shaft furnace is held constant.

* * * * *